US011377915B2

(12) United States Patent
Wood et al.

(10) Patent No.: US 11,377,915 B2
(45) Date of Patent: Jul. 5, 2022

(54) WELLBORE TONG

(71) Applicant: Weatherford Technology Holdings, LLC, Houston, TX (US)

(72) Inventors: Kevin Wood, Houston, TX (US); Arne Tjark Becker, Houston, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 814 days.

(21) Appl. No.: 16/274,952

(22) Filed: Feb. 13, 2019

(65) Prior Publication Data

US 2020/0256137 A1 Aug. 13, 2020

(51) Int. Cl.
*E21B 19/16* (2006.01)

(52) U.S. Cl.
CPC ..... *E21B 19/161* (2013.01)

(58) Field of Classification Search
CPC ..... E21B 19/161; B25B 13/50
See application file for complete search history.

(56) References Cited

U.S. PATENT DOCUMENTS 2,618,468 A 11/1952 Lundeen
3,141,362 A 7/1964 Tamny et al.
3,875,826 A 4/1975 Dreyfuss et al.
5,501,107 A 3/1996 Snyder et al.
6,050,156 A 4/2000 Buck
7,090,254 B1 8/2006 Pieras et al.
7,114,235 B2 10/2006 Jansch et al.
10,100,593 B2 10/2018 Musemeche
10,760,359 B2 * 9/2020 Clasen ..... E21B 19/10
2002/0088674 A1 7/2002 Wassenhoven
2005/0241442 A1 11/2005 Neves

OTHER PUBLICATIONS

European Search Report in related application 20154203.2 dated Jun. 8, 2020.
Australian Office Action dated Oct. 19, 2020 in related Australian Patent Application No. 2020200591.

* cited by examiner

*Primary Examiner* — David B. Thomas
(74) *Attorney, Agent, or Firm* — Patterson + Sheridan, LLP

(57) ABSTRACT

A tong for use at a wellbore includes a tong body; at least one door pivotally coupled to the tong body and movable between an open position and a closed position; a carrier ring rotatable relative to the tong body; and a brake plate coupled to the carrier ring. The tong also includes a brake band configured to move with the at least one door between the open and closed positions, and a braking member for moving the brake band into contact with the brake plate to stop rotation of the carrier ring.

20 Claims, 21 Drawing Sheets

WELLBORE TONG

BACKGROUND

Field

Embodiments described herein generally relate to a tong for use at a wellbore. In particular, embodiments described herein relate to a braking assembly for a tong. In particular still, embodiments described herein relate to a brake band for a braking assembly for a tong.

Description of the Related Art

Wellbore tongs are well known in the art for making and breaking threaded connections between tubulars as strings are assembled or disassembled for use in a wellbore. Typically, a back-up or lower tong holds a tubular extending from the wellbore while an upper tong grasps and then rotates a new tubular into or out of the string. In most cases, the upper tong includes a mechanism to grasp the tubular and then, in a separate step, rotates the tubular to perform threading or unthreading. During the grasping step, one rotating portion of the assembly must be held in place while the gripping assembly operates. Thereafter, both portions are rotated as a unit during the threading operation. There is a need for an improved braking assembly for preventing or stopping a rotatable component of the tong.

SUMMARY

In one embodiment, a tong for use at a wellbore includes a tong body; at least one door pivotally coupled to the tong body and movable between an open position and a closed position; a carrier ring rotatable relative to the tong body; and a brake plate coupled to the carrier ring. The tong also includes a brake band configured to move with the at least one door between the open and closed positions, and a braking member for moving the brake band into contact with the brake plate to stop rotation of the carrier ring.

In another embodiment, a method of operating a tong includes opening a door of the tong, wherein the tong includes a tong body; the door pivotally coupled to the tong body; a carrier ring rotatable relative to the tong body; a brake plate coupled to the carrier ring; and a brake band having a door band portion attached to the door. The method also includes moving the door band portion of the brake band with the door as the door opens; closing the door; moving the brake band into contact with the carrier ring, thereby preventing rotation of the carrier ring; and rotating a gear ring relative to the carrier ring.

In another embodiment, a method of operating a tong includes opening a door of the tong. The tong may include a tong body; the door pivotally coupled to the tong body; a carrier ring rotatable relative to the tong body; a brake plate coupled to the carrier ring; and a brake band having a door band portion attached to the door. The method also includes moving the door band portion of the brake band with the door as the door opens; closing the door; rotating the carrier ring; and moving the brake band into contact with the brake plate, thereby stopping rotation of the carrier ring.

In one embodiment, a tong for use at a wellbore includes a tong body; at least one door pivotally coupled to the tong body and movable between an open position and a closed position; a gripping assembly rotatable relative to the tong body; and a brake plate coupled to the gripping assembly. The tong may also include a brake band configured to move with the at least one door between the open and closed positions; and a braking member for moving the brake band into contact with the brake plate to stop rotation of the gripping assembly.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

DETAILED DESCRIPTION

Figure 1:
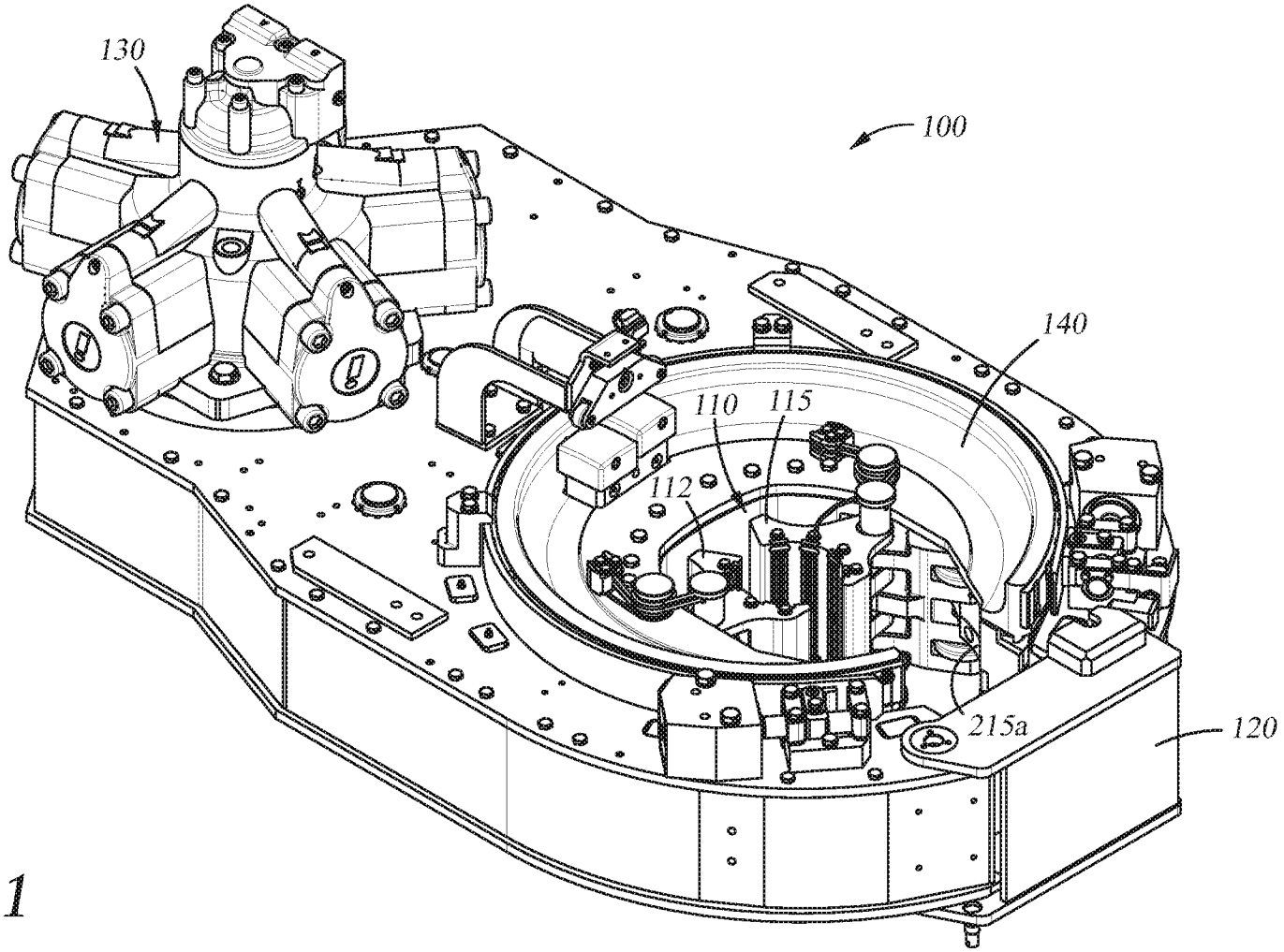
FIG. 1 is a perspective view of a wellbore tong.

FIG. 1 is a perspective view of a wellbore tong. The tong has two functions: it grasps a tubular (not shown) using a gripping assembly generally shown as 110 and thereafter, it rotates the tubular relative to a tubular therebelow in order to make or break a threaded connection therebetween. A door 120, shown in a closed position, permits the tubular to be inserted into the gripping assembly 110 of the tong 100. A hydraulic motor assembly generally shown as 130 rotates a gear ring (not visible) that is responsible for rotation of the tubular when a connection is made. Separately, a "cage" or brake plate 140 is rotatable independent of the gear ring. In the embodiment shown, the gripping assembly 110 is associated with the rotatable brake plate 140 and rotates therewith. Separately, inwardly facing ramps (not visible) are formed on an inner surface of the gear ring. To grip a tubular with the tong 100, it is necessary to rotationally fix the brake plate 140 with its gripping assembly 110 while rotating the gear ring in order to urge the ramps of the gear ring under a plurality of wheels associated with the gripping assembly 110. The action of the wheels and ramps acts to close gripping members 112, 115 around the tubular. With the tubular gripped, both the gear ring and the brake plate 140 rotate together to make (or break) a connection.

Figure 2:
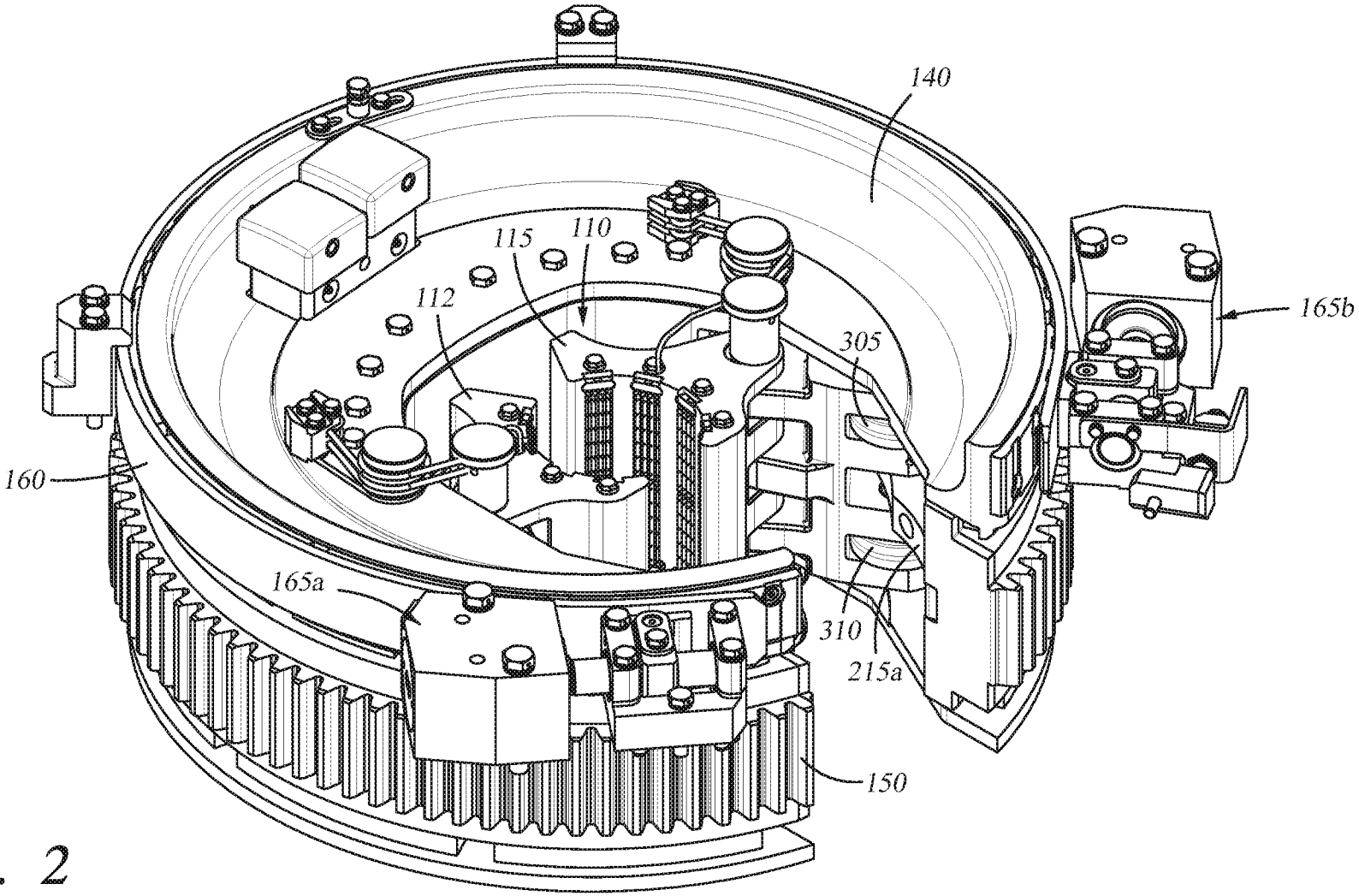
FIG. 2 is a perspective view of a portion of the tong including a rotatable brake plate, a gripping assembly rotatable therewith and a separately rotatable gear ring.

FIG. 2 is a perspective view of a portion of the tong 100 including the rotatable brake plate 140, the gripping assembly 110 rotatable therewith and a separately rotatable gear ring 150. The gear ring includes teeth formed on a perimeter thereof for engagement with corresponding teeth associated with the motor assembly 130 (FIG. 1). Also shown in FIG. 2 is a braking assembly for the brake plate in order to stop its rotation during the gripping portion of the operation. The breaking assembly, as will be described in additional detail herein, includes a brake band 160 that can be tightened thereby providing friction between the band 160 and the brake plate 140. The tightening takes place at each end of the band with piston-actuated braking members 165*a*, 165*b*.

Figure 3:
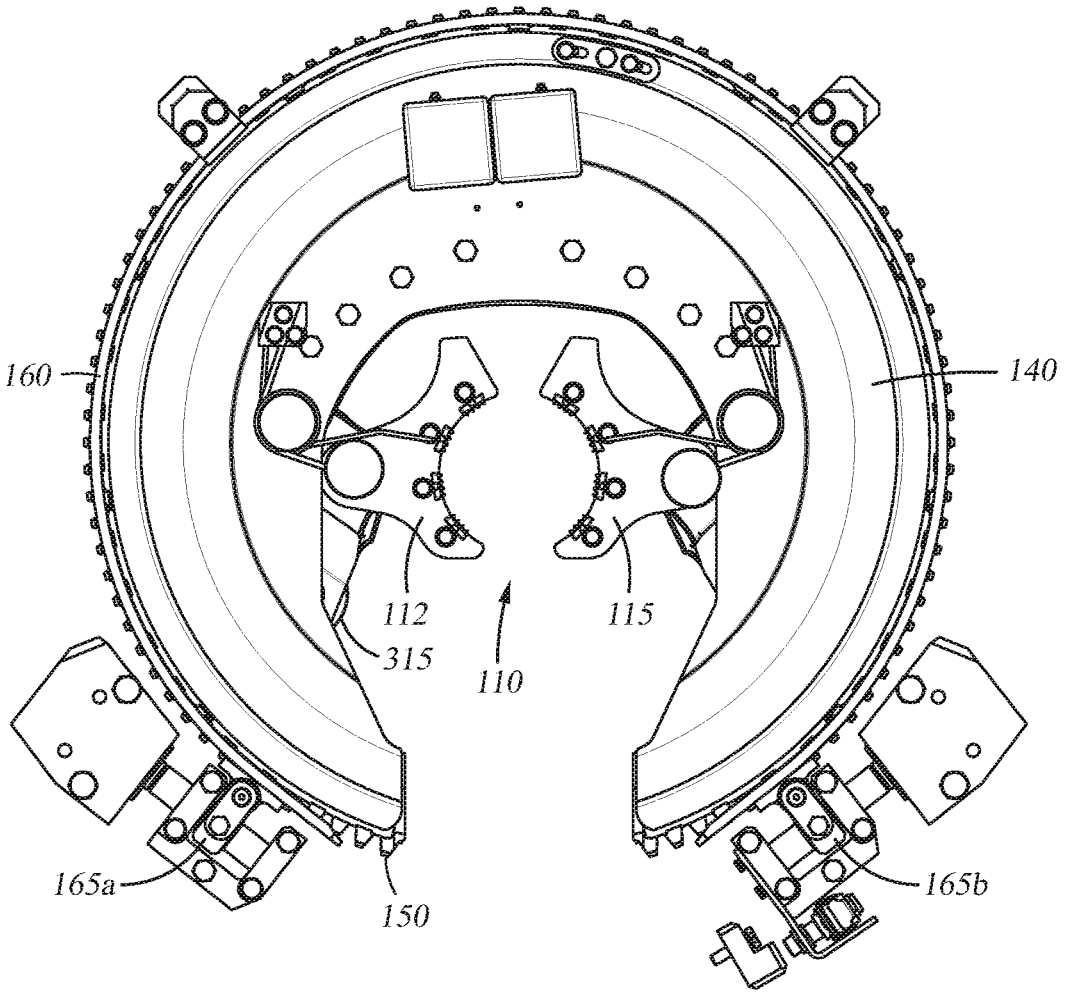
FIG. 3 is a top view of the assembly of FIG. 2 showing gripping members that are a part of the gripping assembly.

FIG. 3 is a top view of the assembly of FIG. 2 showing gripping members 112, 115 that are a part of the gripping assembly 110. As illustrated, the gripping members can be actuated towards or away from the centerline of a tubular.

Figure 4:
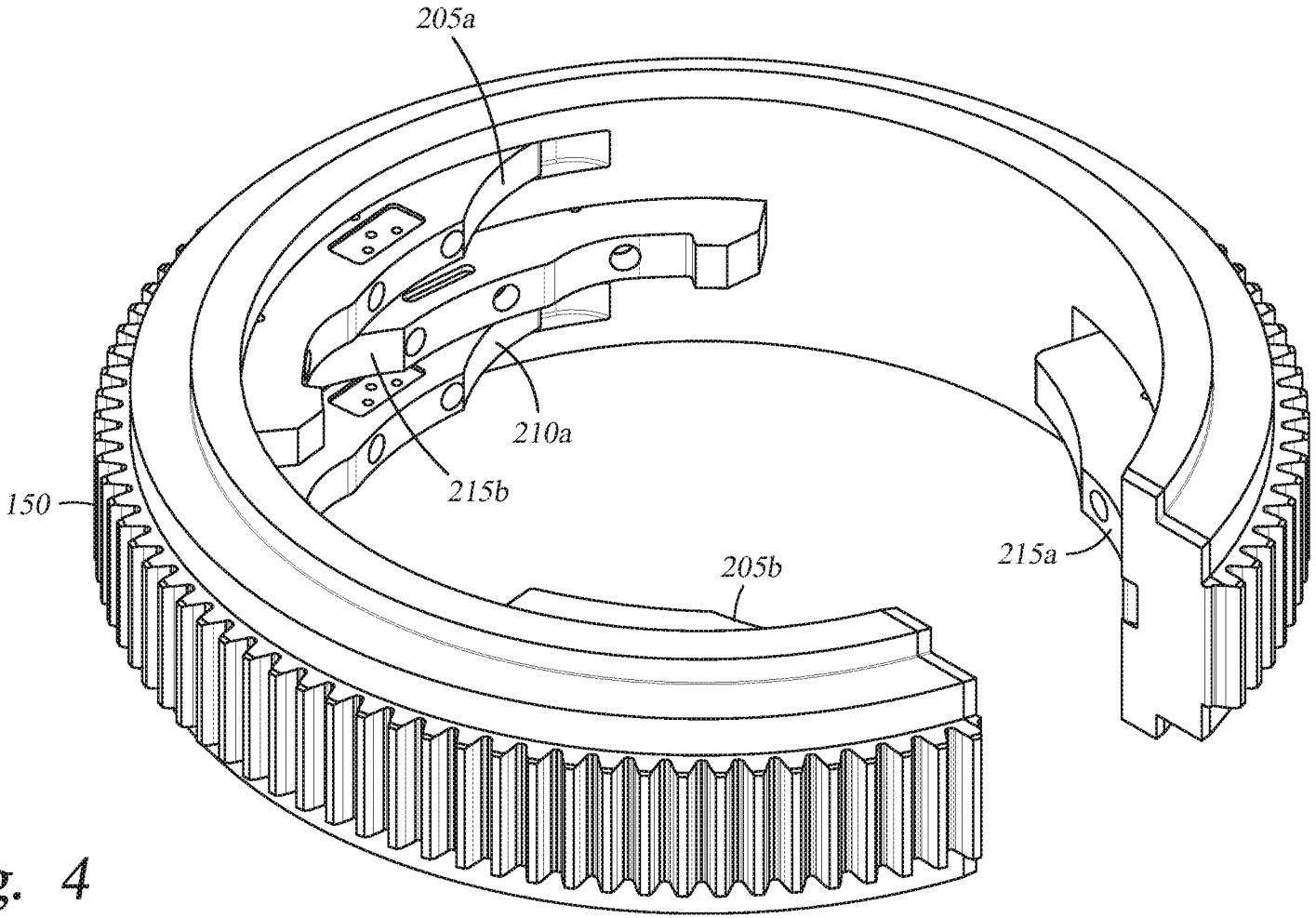
FIG. 4 is a perspective view of the gear ring showing a plurality of ramps formed on an inner surface thereof.

FIG. 4 is a perspective view of the gear ring 150 showing a plurality of ramps 205*a*, 210*a*, 215*b* formed on an inner surface thereof opposite an opening or throat of the ring. The upper and lower ramps 205*a*, 210*a* are constructed and arranged to operate with a set of double wheels 305, 310 (FIG. 5) in order to actuate one gripping member 115 of the gripping assembly 110 when a threaded connection is being made. The center ramp 215*b*, as is evident by its direction is constructed and arranged to actuate a single wheel 315 associated with gripping member 112 when a connection between tubulars is being broken. An opposite group of ramps, two of which 215*a*, 205*b* are visible in FIG. 4 are responsible for a reverse arrangement wherein a second set of double ramps (upper ramp 205*b* is visible) operates with the double wheels 305, 310 to break a connection and a second single ramp 215*a* operates with the single wheel 315 when a connection is made.

Figure 5:
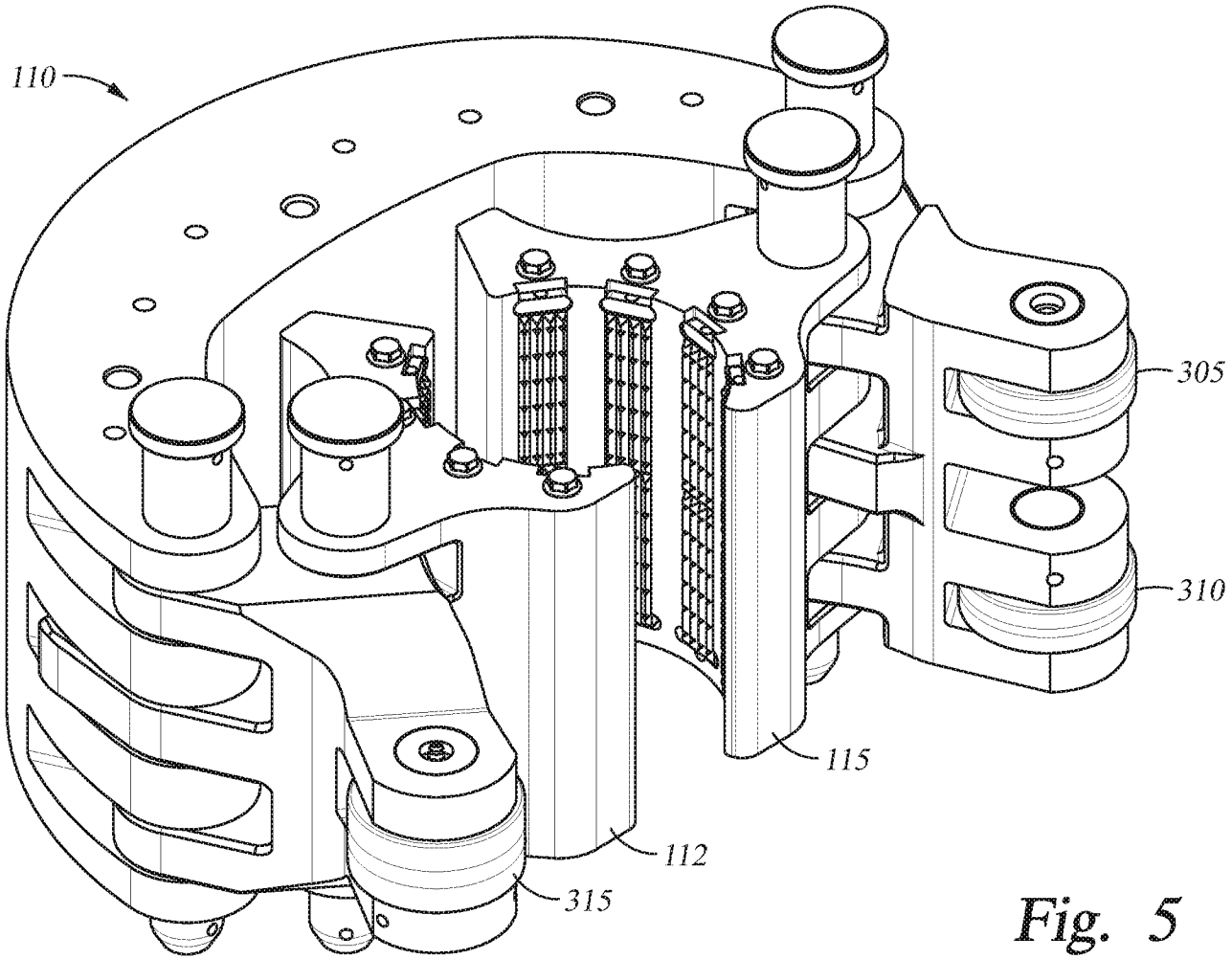
FIG. 5 is a perspective view of the gripping assembly illustrating a double pair of wheels on a first side and a single wheel on a second side.

FIG. 5 is a perspective view of the gripping assembly 110 illustrating the double pair of wheels 305, 310 on a first side and the single wheel 315 on a second side. The gripping assembly 110 is made up of two gripping members 112, 115, each operating like a slip with an inner surface having a concave shape to match the outer surface of the tubular to be grasped by the tong 100. As illustrated, the gripping assembly 110 utilizes the single wheel 315 associated with one gripping member 112 and the two-wheel set 305, 310 operating with a second gripping member 115. In operation, the wheels (along with the brake plate 140) remain rotationally fixed while the gear ring 150 with its various ramps rotates to a position wherein each wheel has ridden up a ramp. The result is a clamping action forcing the gripping members 112, 115 into contact with the tubular to be grasped. The make or break nature of the operation determines which set of ramps is utilized by the wheels as the tubular is gripped.

Figure 6:
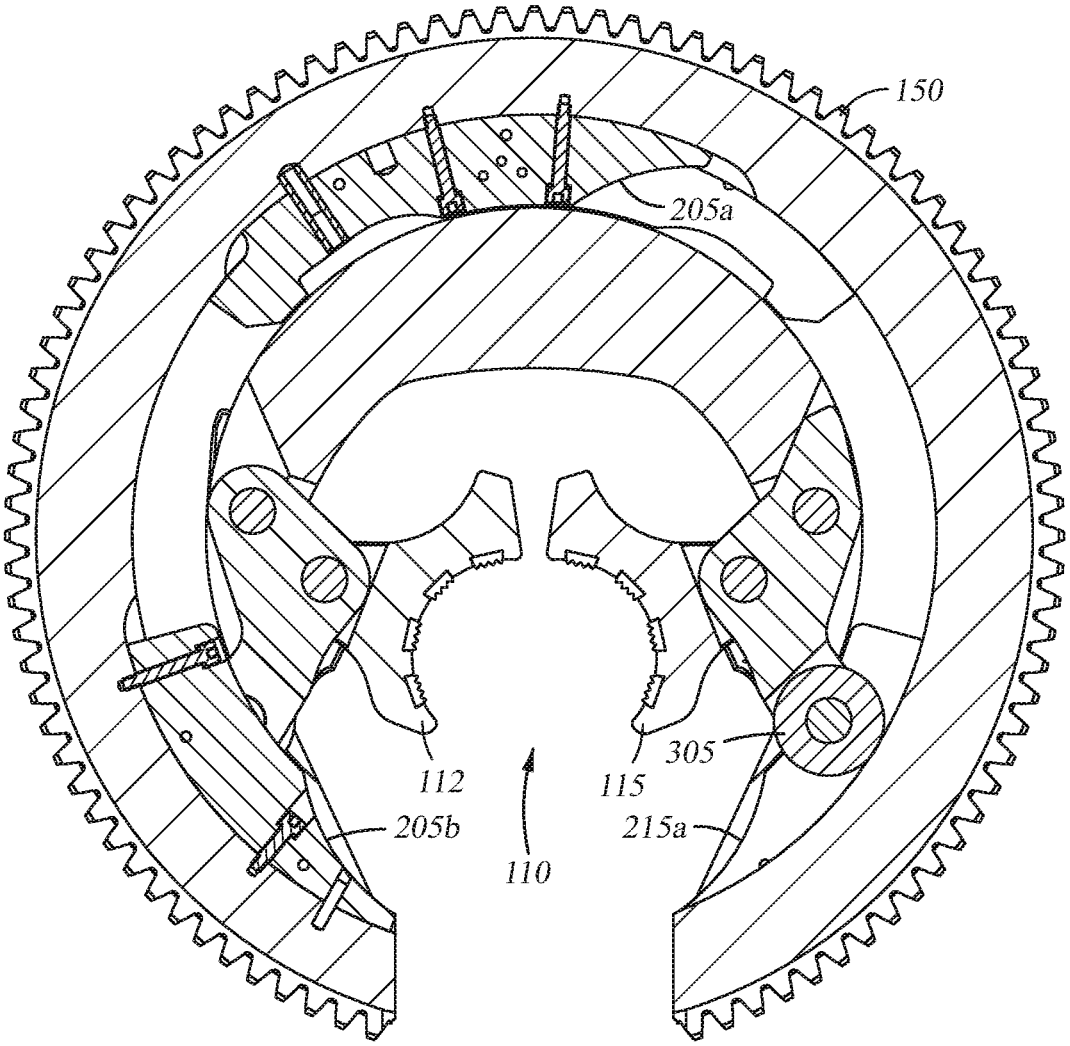
FIG. 6 is a top view partially in section, taken through one wheel of the double pair of wheels.
Figure 7:
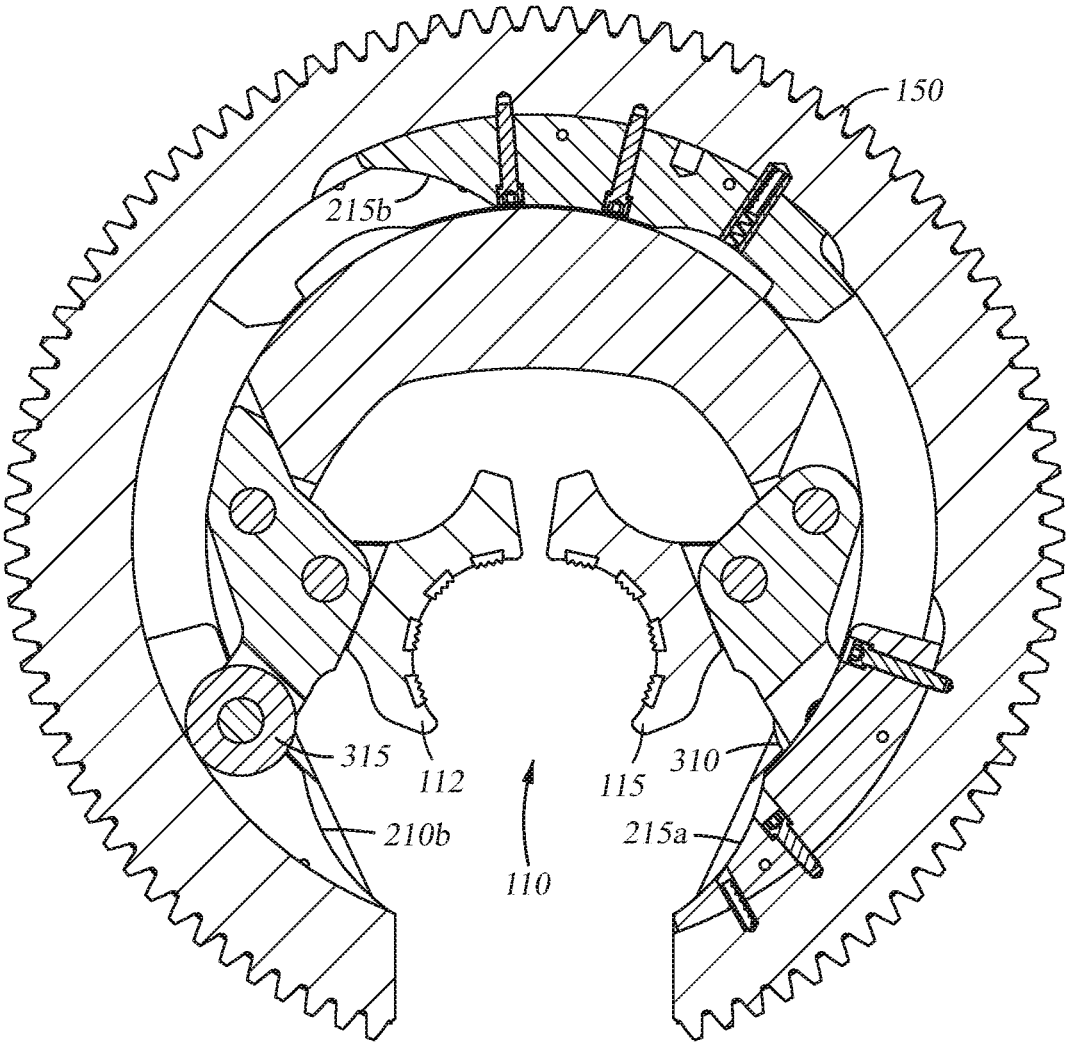
FIG. 7 is a top view partially in section, taken through the single wheel.

FIG. 6 is a top view partially in section, taken through one wheel 305 of the double pair of wheels 305, 310 and FIG. 7 is a top view partially in section, taken through the single wheel 315. In both Figures, the gripping mechanism is de-activated, meaning that the wheels and ramps are not in contact with one another as indicated by the open position of the gripping members 112, 155 in each Figure. For example, in FIG. 6, upper wheel 305 of the pair of wheels 305, 310 is visible above the ramp 215*a* that is designed to operate in conjunction with single wheel 315 when a connection is being made up. Similarly in FIG. 7, on the left side of the Figure, the single wheel 315 is visible with the lower ramp 210*b* below it.

Figure 8:
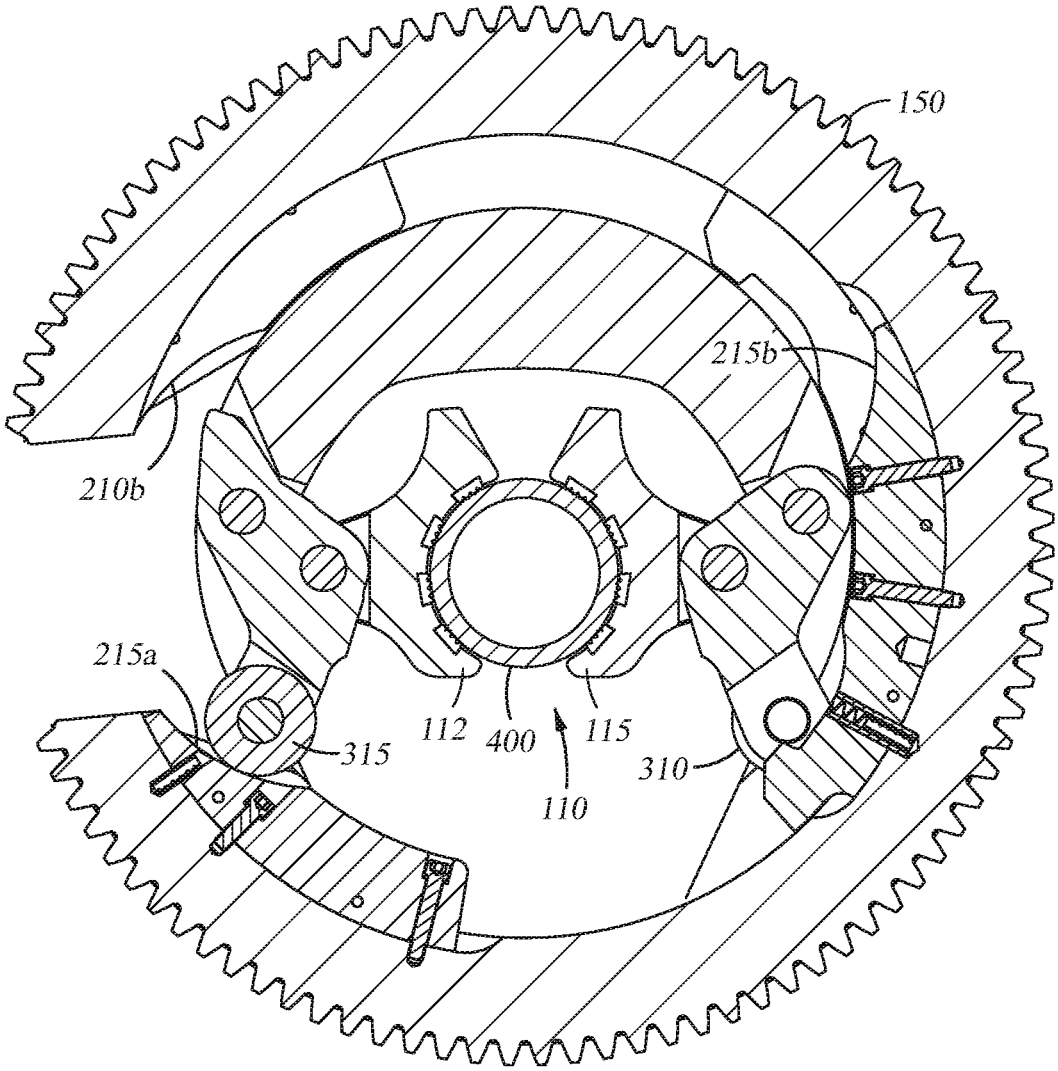
FIG. 8 is a top view partially in section, taken through the single wheel and showing the gripping assembly actuated around a tubular.

FIG. 8 is a top view partially in section, taken through the single wheel 315 and showing the gripping assembly 110 actuated around a tubular 400. More specifically, FIG. 8 is a top section view of the assembly shown in FIGS. 7 and 8 with the view taken through the single wheel 315. However, in FIG. 8 the gear ring 150 with its sets of ramps has been rotated clockwise while the brake plate 140 and gripping assembly 110 have been rotationally held in the same orientation as they are in FIGS. 7 and 8. The result is that the ramps have changed location relative to the wheels 305, 310, 315 in a manner whereby the wheels have mounted the ramps 215*a*, 205*a*, 210*a* that are designed to be utilized in actuating the gripping mechanism in order to make a connection. Because the wheels have been actuated by the ramps, the gripping mechanism 110 is actuated and the tubular 400 is gripped.

Figure 9:
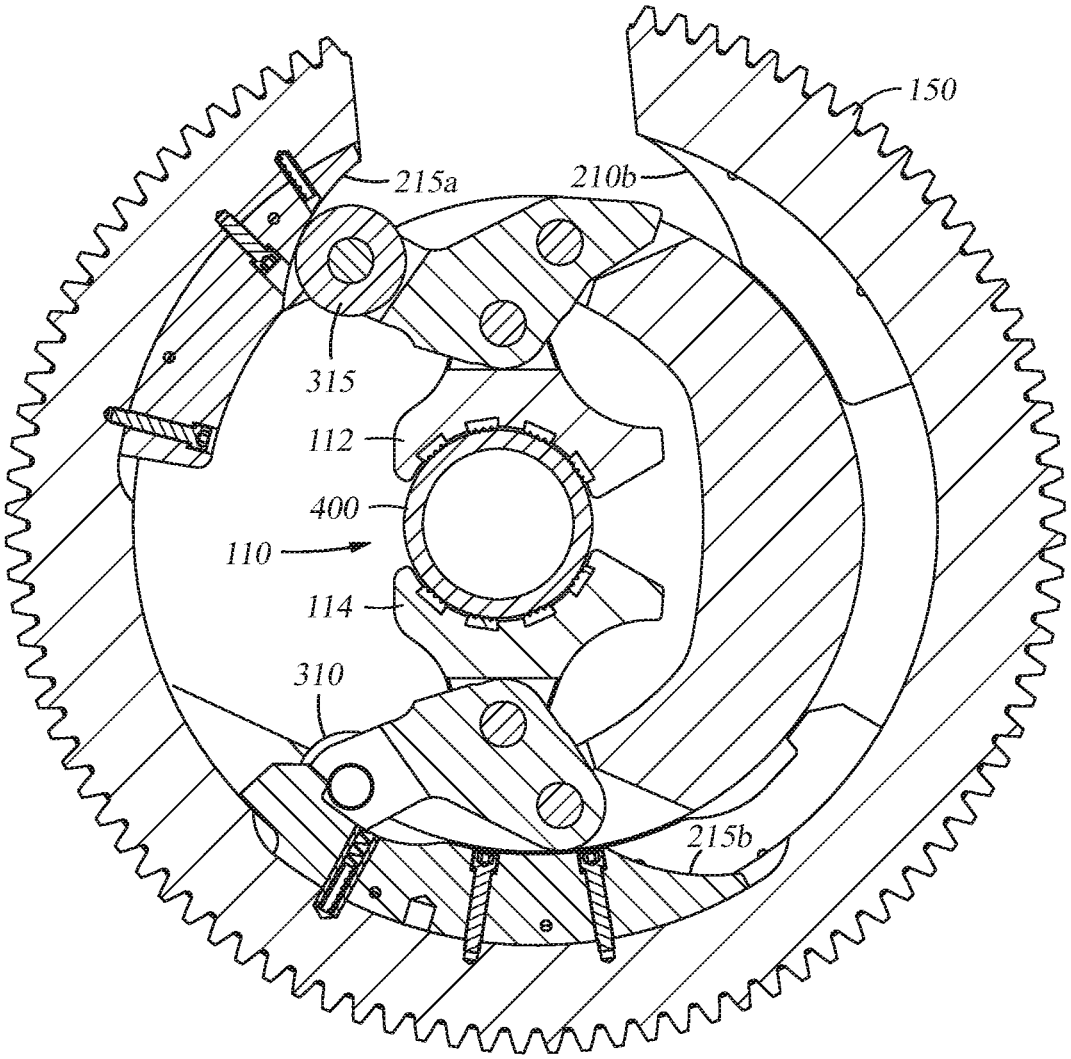
FIG. 9 is a top view partially in section, taken through the single wheel and showing the tubular member having been rotated in a clockwise direction to make a wellbore connection between tubulars.

FIG. 9 is a top view partially in section, taken through the single wheel 315 and showing the tubular member 400 having been rotated in a clockwise direction to make a wellbore connection between tubulars. Comparing FIGS. 8 and 9, in FIG. 9 the entire tong unit including gear ring 150 and brake plate 140 has been rotated as a unit. In this manner the tubular 400 retained by the upper portion of the tong 100 is rotated relative to a tubular gripped by a lower portion (not shown) in order to make a threaded connection. It will be appreciated the operation can be reversed, using the same wheels but operating on another set of ramps having reverse formations. In this manner, the tong assembly can be used to make or break a threaded connection between tubulars.

As described above, in order to actuate the gripping assembly 110, the brake plate 140 and gripping assembly must be rotationally fixed or at least rotationally limited relative to the gear ring while the gear ring 150 with its inwardly facing ramps rotates to a location whereby the ramps interact with the wheels of the gripping assembly to close the gripping members 112, 115 around a tubular 400. Thereafter, the gear wheel 150 and brake plate 140 rotate together to make or break a threaded connection. In one embodiment, rotation of the brake plate 140 is prevented with the use of a brake band 160 that is tightened around an outer surface of the plate in order to prevent its rotation. The brake band 160 and braking members 165*a, b* are shown in FIGS. 2 and 3. As shown, the band 160 extends around an outer perimeter of the plate 140 and is held at each end by one of the braking members. By holding the band at each end, the brake members can tighten the band 160 by urging each end towards the door 120 of the assembly, essentially removing slack in the band and thereby increasing its friction with the side of the brake plate 140. In one embodiment, the braking members each include a piston that urges a corresponding end of the brake band 160 in order to tighten it.

Figure 10:
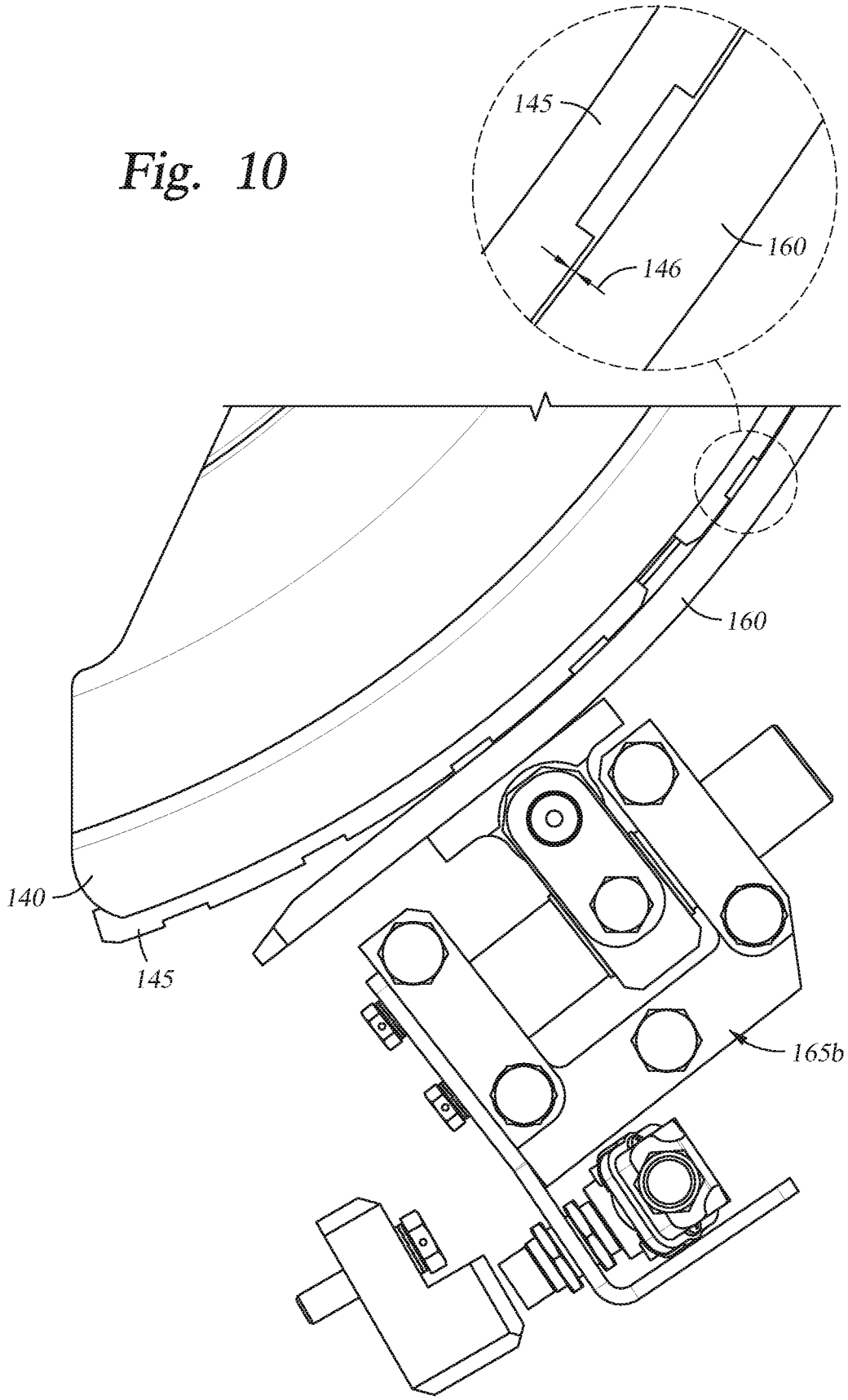
FIGS. 10 and 11 are top views of a braking member illustrating its operation in conjunction with a brake band to prevent rotation of the brake plate.
Figure 11:
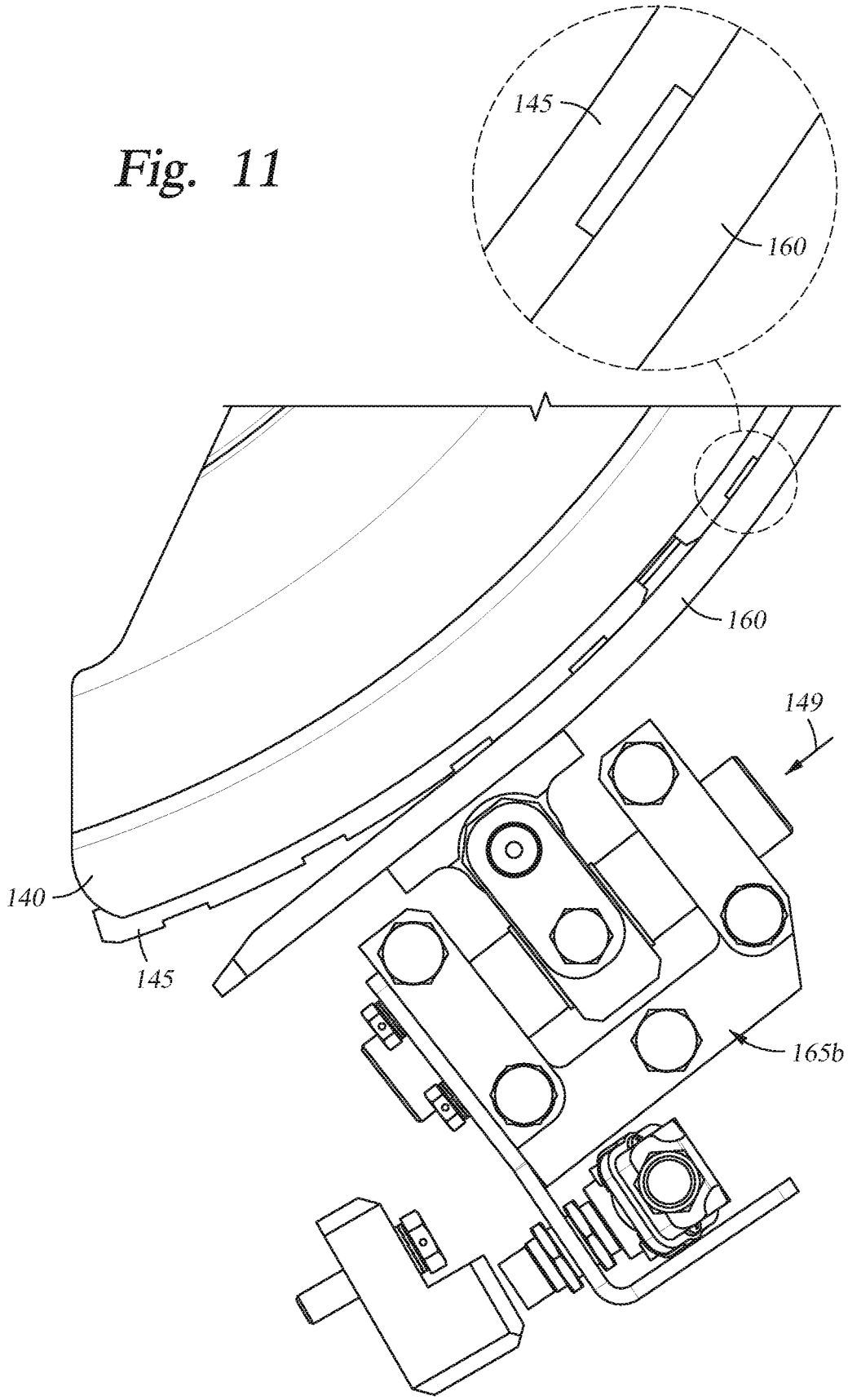

FIGS. 10 and 11 are top views showing the operation of one of the braking members 165*b* and its relationship with the brake plate 140. In FIG. 10 the brake is un-actuated as shown by a gap 146 formed between the band and an outer edge of a brake pad 145 disposed around an outer edge of the plate. FIG. 11 is a similar view however, in FIG. 11 the brake band has been tightened as apparent by the absence of gap 146 in the Figure. Arrow 149 illustrates the direction of a force placed upon the band in order to tighten it.

One novel aspect of the invention relates to brake pads and their location relative to the brake band and brake plate. In prior art devices, friction and heat generated between the tightened band and brake plate create wear and can cause failure of the entire tong assembly, essentially shutting down operations at a well site. In prior art devices, brake material including non-metallic, semi metallic and ceramic materials has been used on an inner surface of the brake band in order to effect braking between the band and brake plate. In order to extend the life of the brake band and to reduce friction and resulting heat between the surfaces, grease is applied at the intersection of the band and plate. The addition of grease reduces the heat and wear but must be replaced regularly requiring precious time at the working wellsite. Additionally, with or without grease, flexing of the band as it is tightened or loosened can cause the brake material to separate from the band. In one embodiment of the present invention, these problems and others are overcome by placing brake pads made of breaking and friction-reducing material not on the band but on the outer perimeter of the brake plate where it contacts the band.

Figure 12:
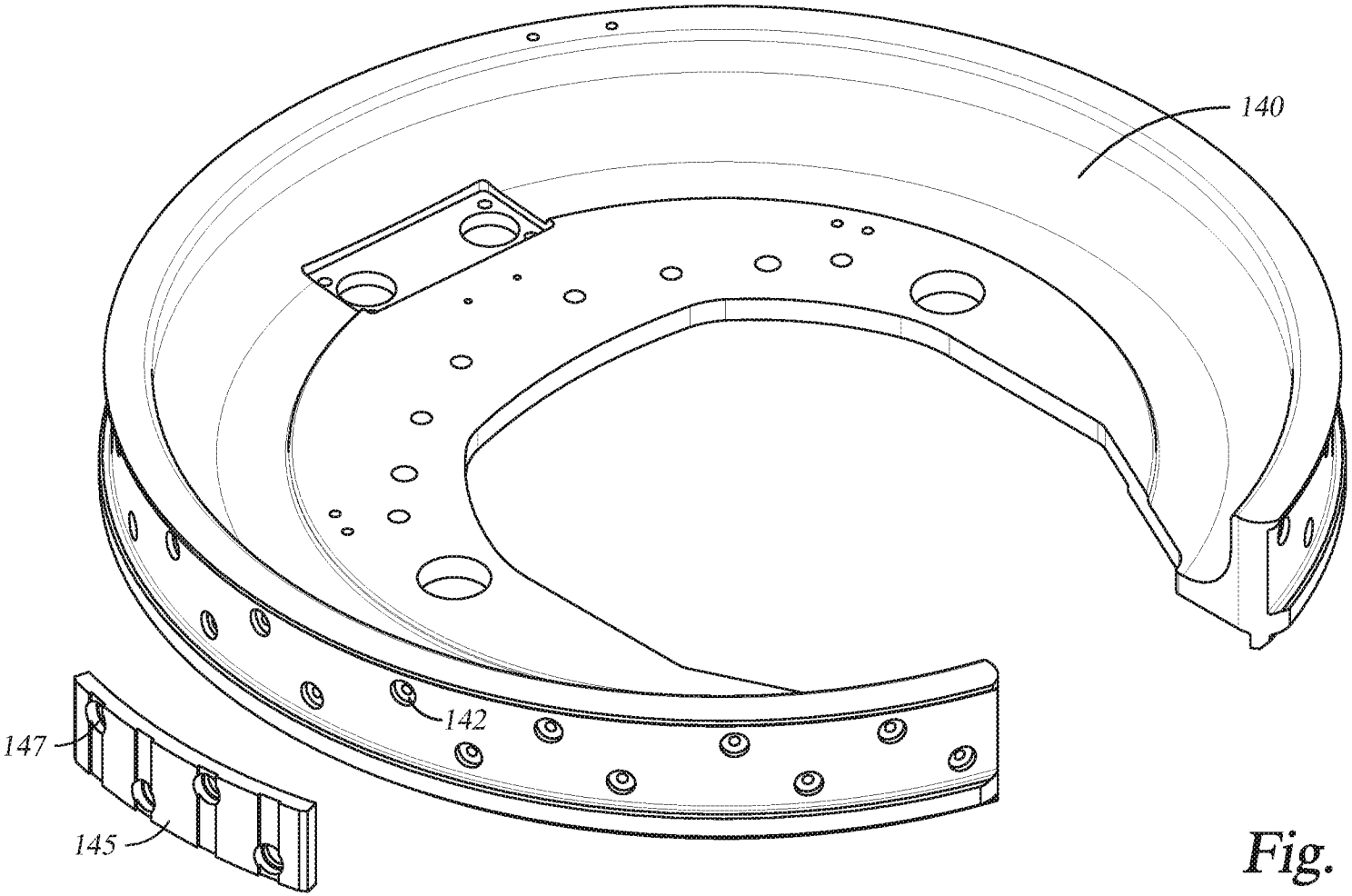
FIG. 12 is a perspective view of a brake plate illustrating the location of brake pads along an outer perimeter thereof.

FIG. 12 is a perspective view of the brake plate having apertures 142 around its perimeter for attachment of brake pads. One exemplary brake pad 145 is shown in the Figure. By fastening the brake pads with fasteners around the perimeter, a braking surface is provided in a manner whereby the material is protected from the flexing of the brake band. Additionally, the pieces can be replaced in any area where excessive wear has occurred without replacing the entire band or a large strip of the braking material. In one example, the brake pads are constructed primarily of bronze or sintered bronze. Bronze is an alloy consisting primarily of copper, commonly with about 12% tin and often with the addition of other metals and sometimes non-metals or metalloids such as arsenic, phosphorus or silicon.

Figure 13:
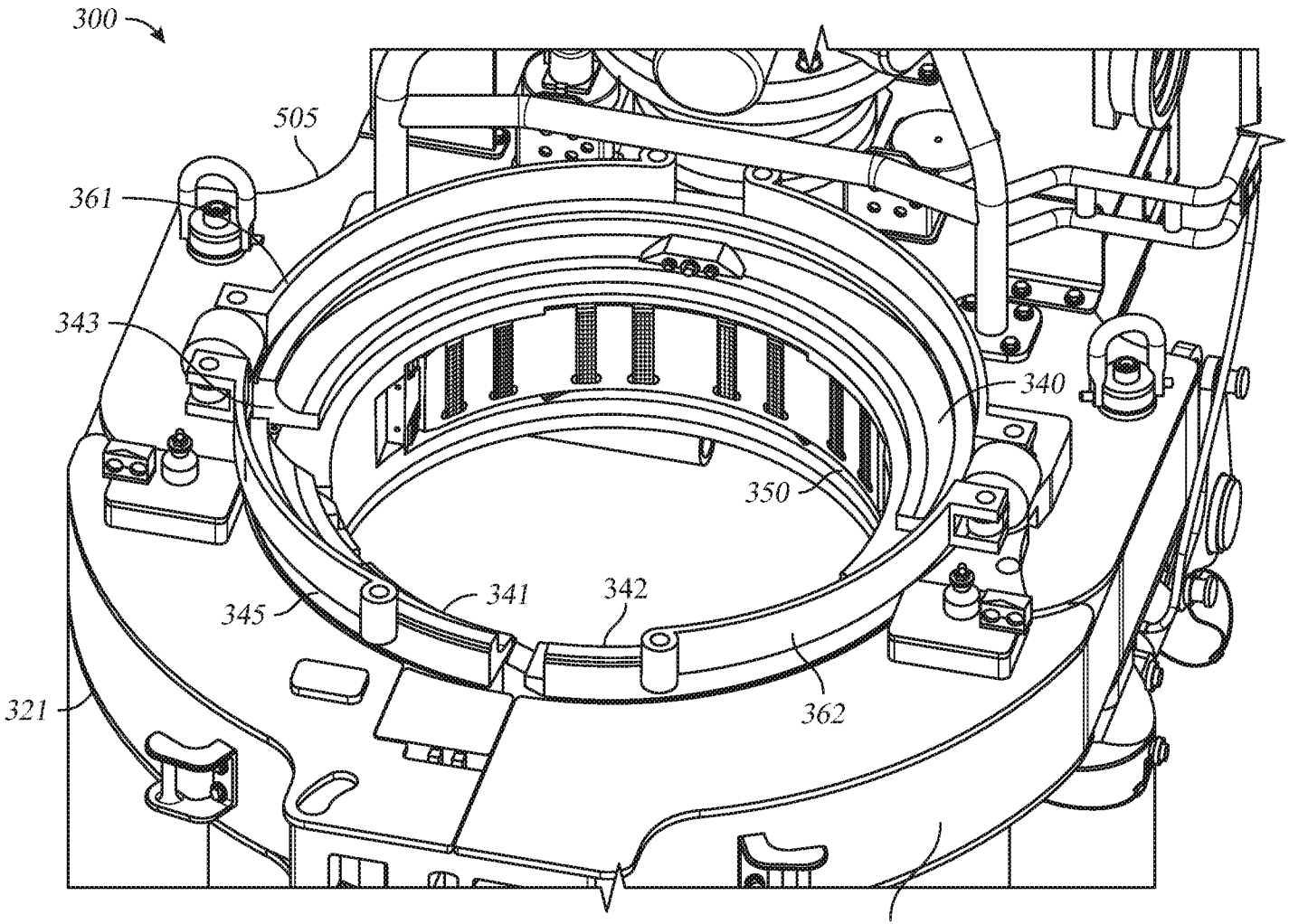
FIG. 13 is a perspective view of another embodiment of a wellbore tong.

FIG. 13 is a perspective view of another embodiment of a wellbore tong 300. The tong 300 includes a body 505 and two doors 321, 322 pivotally connected to the body 505. The doors 321, 322 are opened to allow ingress or egress of a tubular. The doors 321, 322 can be opened using any suitable manner, such as a piston and cylinder assembly or manually. The tong 300 includes a gripping assembly having a carrier ring 350 housing one or more gripping members. It is contemplated that any suitable carrier ring and gripping members, such as those shown in FIGS. 1, 2, 16, and 17 may be used.

In one embodiment, the carrier ring 350 is a segmented carrier ring having a body ring portion and two door ring portions. When the tong 300 is in the unactivated position, the body ring portion is coupled to the body 505, and each door ring portion is coupled to a door 321, 322. The door ring portion is movable with the respective door 321, 322, when the door 321, 322 opens or closes. A gear ring (e.g., gear ring 459 shown in FIG. 17) is coupled to the carrier ring 350.

The tong 300 includes a segmented brake plate 340 having a body plate 343 and two door plates 341, 342. The body plate 343 is attached to the body ring portion, and each door plate 341, 342 is attached to a door ring portion. The brake plate 340 is rotatable with the carrier ring 350. In this embodiment, the brake plate 340 is attached to an upper surface of the carrier ring 350. In another embodiment, the brake plate 340 is attached to a lower surface of the carrier ring 350. The door plates 341, 342 are movable with the respective door 321, 322, when the door 321, 322 opens or closes. In one embodiment, a brake pad 345 is attached to a perimeter wall surface of the brake plate 340. An exemplary brake pad 345 is the brake pad 145 described in FIGS. 10-12. As discussed, one or more of the brake pads 345 can be attached to apertures in the perimeter wall surface of the brake plate 340. In another embodiment, the brake pads can be attached to the brake band 361, 362.

Figure 15:
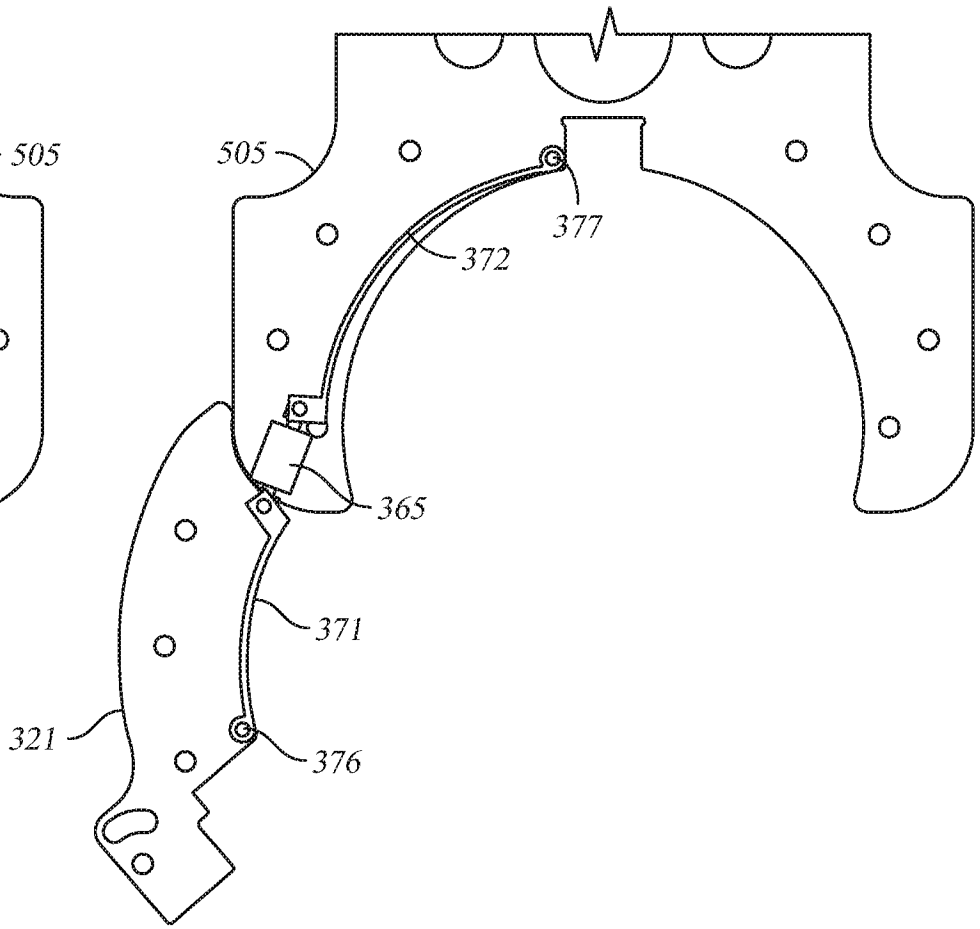
FIG. 15 shows the door of FIG. 14 in an open position.
Figure 14:
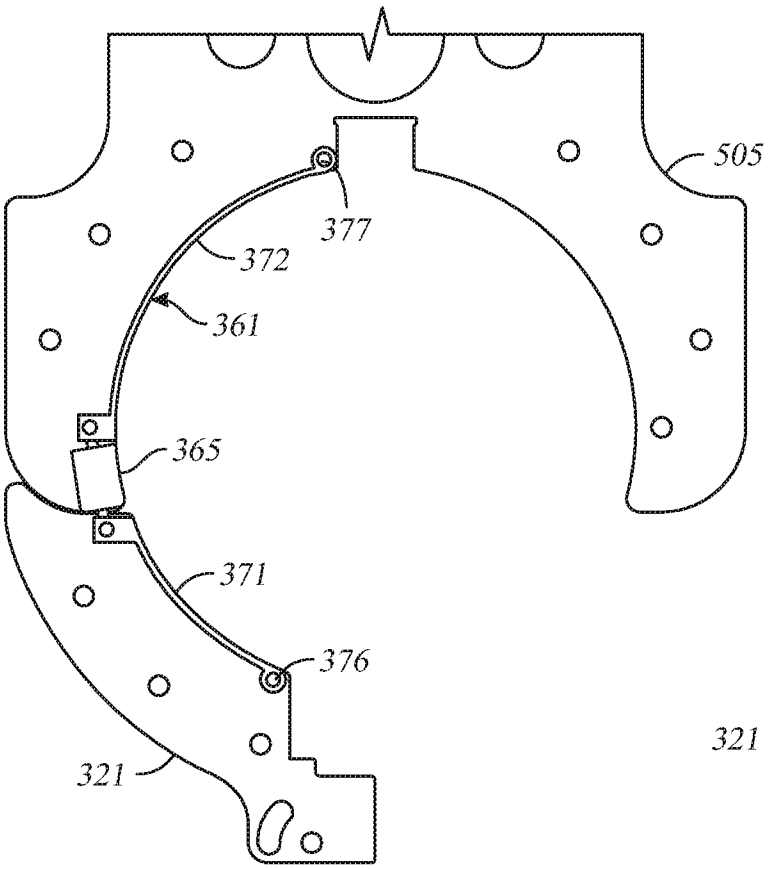
FIG. 14 shows a door of the tong of FIG. 13 in a closed position.

In one embodiment, the tong 300 includes one or more segmented brake bands 361, 362. As shown in FIG. 13, two brake bands 361, 362 are provided on the tong 300. For sake of clarity, only one brake band 361 will be described. FIGS. 14 and 15 show the brake band 361 disposed on the tong 300, which is shown with only one door 321. FIG. 14 shows the door 321 in the closed position. The brake band 361 includes a first band portion 371 coupled to a second band portion 372 using a braking member 365. In one example, the braking member 365 such as a cylinder assembly is used to couple the first and second band portions 371, 372. A piston extends out of one end of the cylinder assembly and is pivotally coupled to one end of each band portion 371, 372. The outer end of the first band portion 371 is pivotally coupled to the first door 321, such as via a first pin connection 376. The outer end of the second band portion 372 is pivotally coupled to the tong body 505, such as via second pin connection 377. In one embodiment, the distance between the first and second pin connections 376, 377 is from 25% to 75% of the circumference of the brake plate 340 or from 35% to 60% of the circumference of the brake plate 340. It is contemplated the braking member can be a dual piston and cylinder that pivotally couples the first band portion 371 and the second band portion 372.

FIG. 15 shows the door 321 in the open position. As the door 321 swings out, the brake band 361 is allowed to pivot about both pin connections 376, 377. The band portions 371, 372 also pivot about the connections with the pistons of the braking member 365.

The brake band 361 is shown in FIG. 14 in the unactuated position. A gap exists between the brake band 361 and the brake plate 340. To stop rotation of the brake plate 340, the braking member 365 is actuated to tighten the brake band 361. For example, one or both of the pistons of the braking member 365 are retracted to move at least a portion of the brake band 361 into contact with the brake plate 340. As a result, friction between the brake band 361 and the brake plate 340 is increased, thereby stopping rotation of the brake plate 340 and the carrier ring 350.

Figure 16:
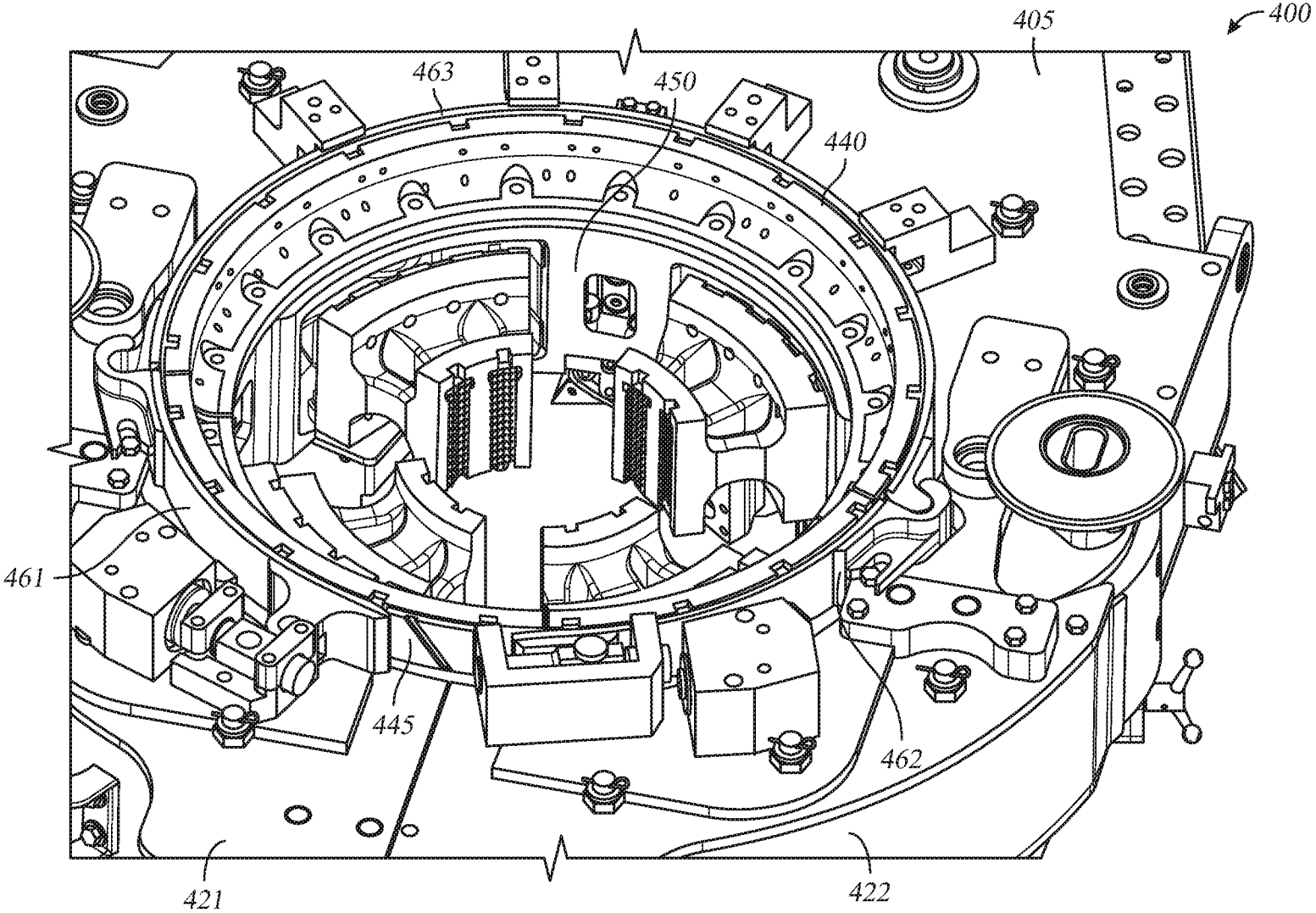
FIG. 16 is a perspective bottom view of another embodiment of a wellbore tong.
Figure 17:
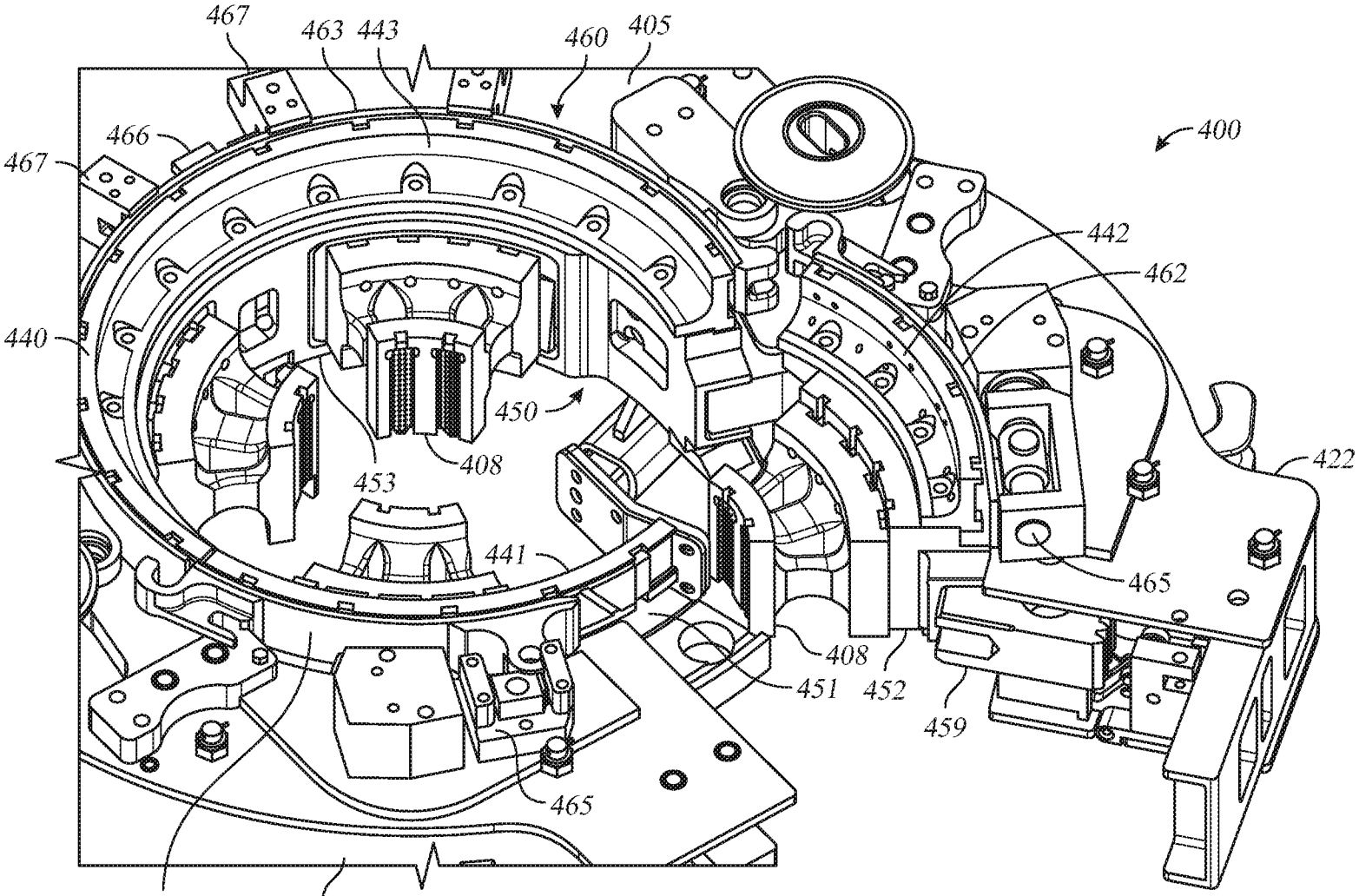
FIG. 17 is a perspective view of the tong of FIG. 16 with one door in the open position.

FIG. 16 is a perspective bottom view of another embodiment of a wellbore tong 400. FIG. 17 is a perspective view of the tong 400 with one door 422 in the open position. The tong 400 includes a body 405 and two doors 421, 422 pivotally connected to the body 405. The doors 421, 422 are opened to allow ingress or egress of a tubular. The doors 421, 422 can be opened using any suitable mechanism, such as a piston and cylinder assembly or manually. The tong 400 includes a gripping assembly having a carrier ring 450 housing one or more gripping members 408.

In one embodiment, the carrier ring 450 is a segmented carrier ring having a body ring portion 453 and two door ring portions 451, 452. When the tong 400 is in the unactivated position, the body ring portion 453 is coupled to the body 405, and each door ring portion 451, 452 is coupled to a door 421, 422. The door ring portion 451, 452 is movable with the respective door 421, 422, when the door 421, 422 opens or closes. A gear ring 459 is coupled to the carrier ring 450 and is selectively rotatable relative to the carrier ring 450. The gear ring 459 is segmented to accommodate movement of the door ring portions 451, 452 with the doors 421, 422.

The tong 400 includes a segmented brake plate 440 having a body plate 443 and two door plates 441, 442. The body plate 443 is attached to the body ring portion 453, and each door plate 441, 442 is attached to a door ring portion 451, 452. The brake plate 440 is rotatable with the carrier ring 450. In this embodiment, the brake plate 440 is attached to a lower surface of the carrier ring 450. In another embodiment, the brake plate 440 is attached to an upper surface of the carrier ring 450. The door plates 441, 442 are movable with the respective door 421, 422, when the door 421, 422 opens or closes. In one embodiment, a brake pad 445 is attached to a perimeter wall surface of the brake plate 440. An exemplary brake pad 445 is the brake pad 145 described in FIGS. 10-12. As discussed, one or more brake pads 445 can be attached to apertures in the perimeter wall surface of the brake plate 440. In another embodiment, the brake pads can be attached to the brake band 460.

Figure 18:
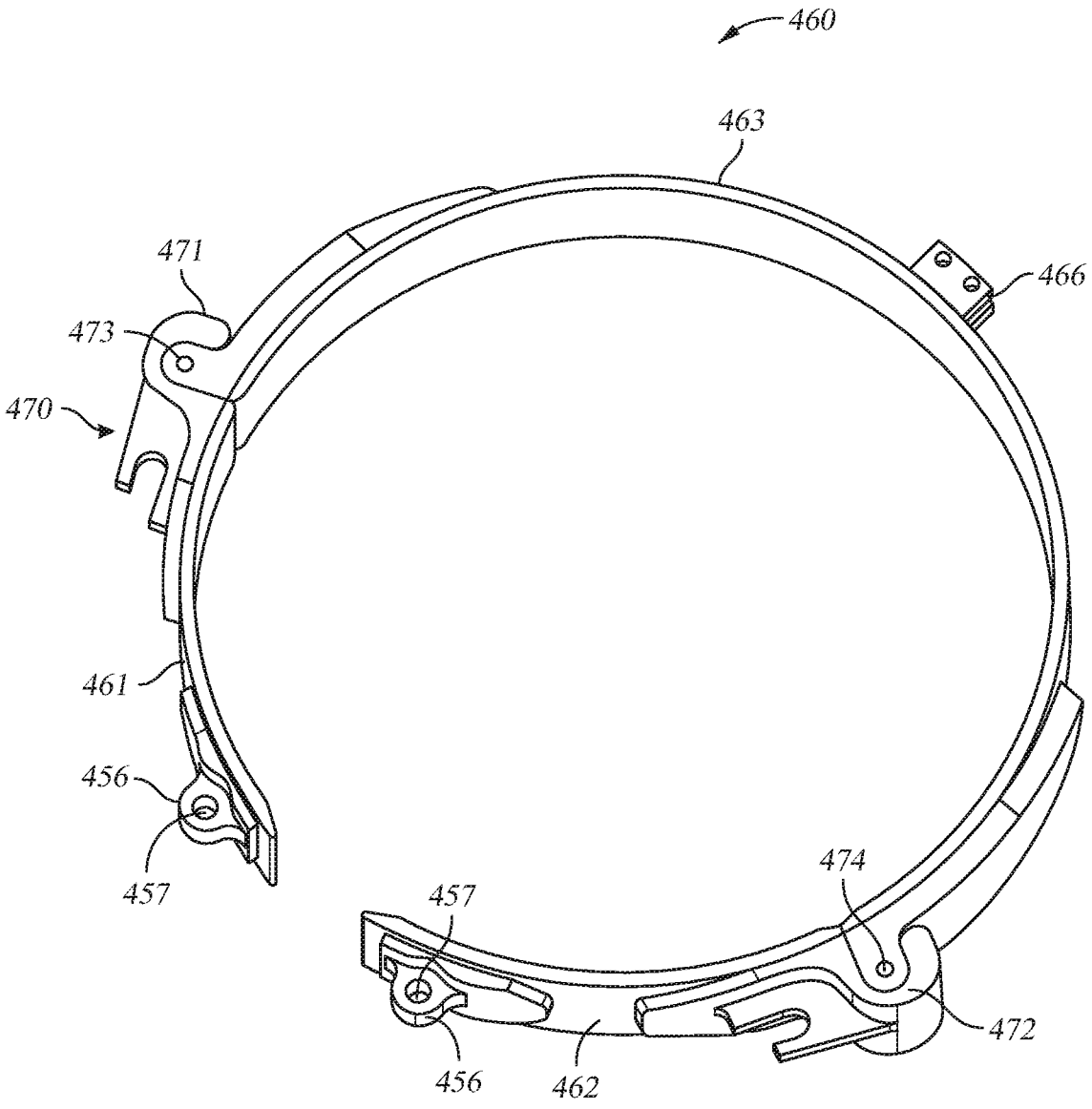
FIG. 18 is a perspective view of an embodiment of a brake band.

In one embodiment, the tong 400 includes a brake band 460 having a plurality of segments 461, 462, 463. FIG. 18 shows an exemplary embodiment of the brake band 460. The brake band 460 is disposed around a perimeter of the brake plate 440 and configured to make contact with the brake plate 440. The brake band 460 includes a body band 463 coupled to the body 405 of the tong 400. The brake band 460 may be attached to the body 405 using a bracket 466. One or more retainers 467 may be used to keep the brake band 460 in position around the brake plate 440. The first and second door bands 461, 462 are coupled to the doors 421, 422, respectively, and are movable with the doors 421, 422 as the doors 421, 422 open or close. In this embodiment, the door bands 461, 462 are coupled to the doors 421, 422 using a braking member 465 such as a piston and cylinder assembly. In one embodiment, the door bands 461, 462 include a hinge 456 for pivotally coupling with the piston of the braking member 465. For example, a pin can be inserted through a hole 457 in the hinge 456 and a hole in the piston. In this manner, the door bands 461, 462 can be moved by the respective braking member 465.

Figure 19:
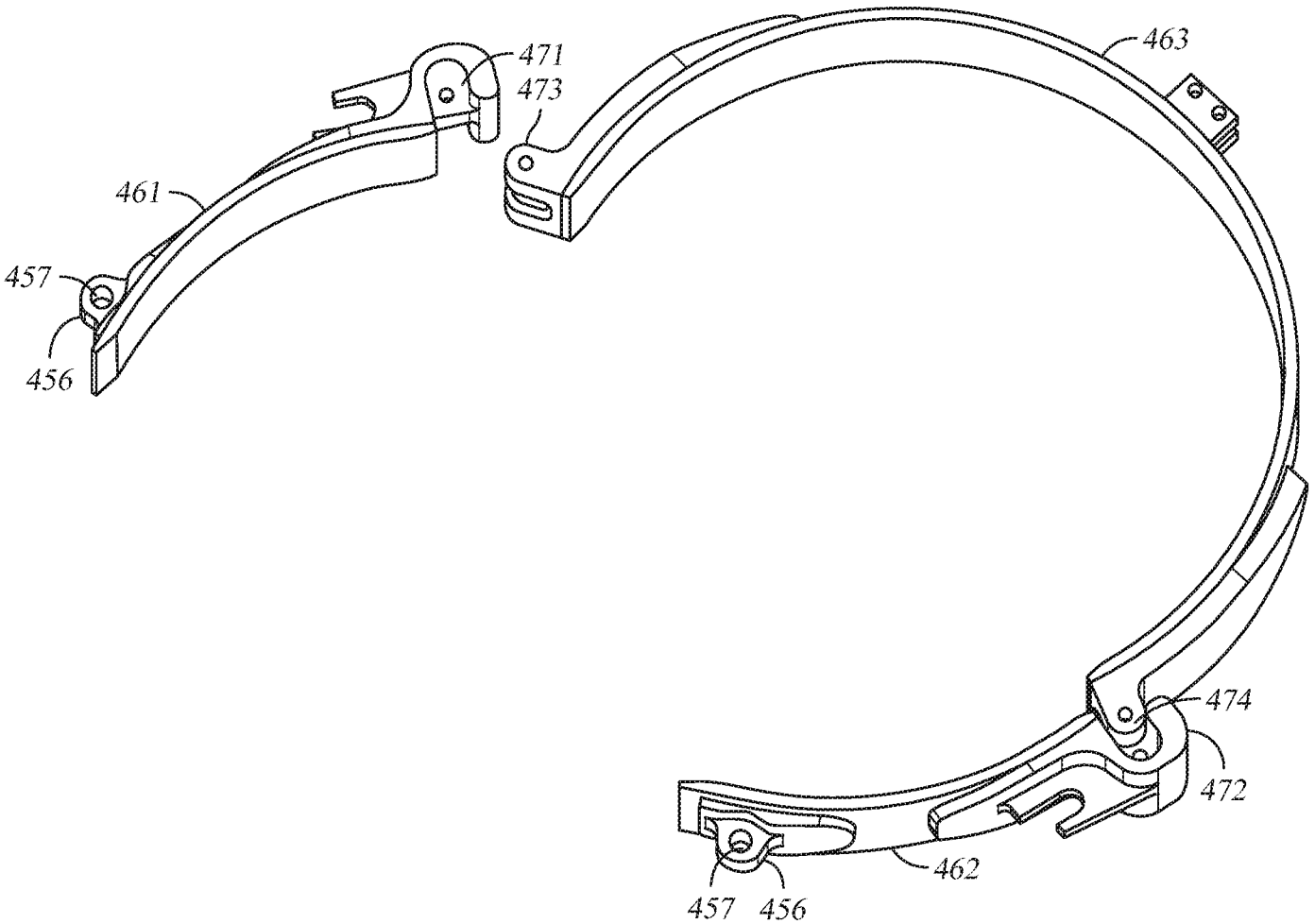
FIG. 19 is a perspective view of the brake band of FIG. 18 with a first door band in the disengaged position and a second door band in a partially disengaged position.
Figure 20:
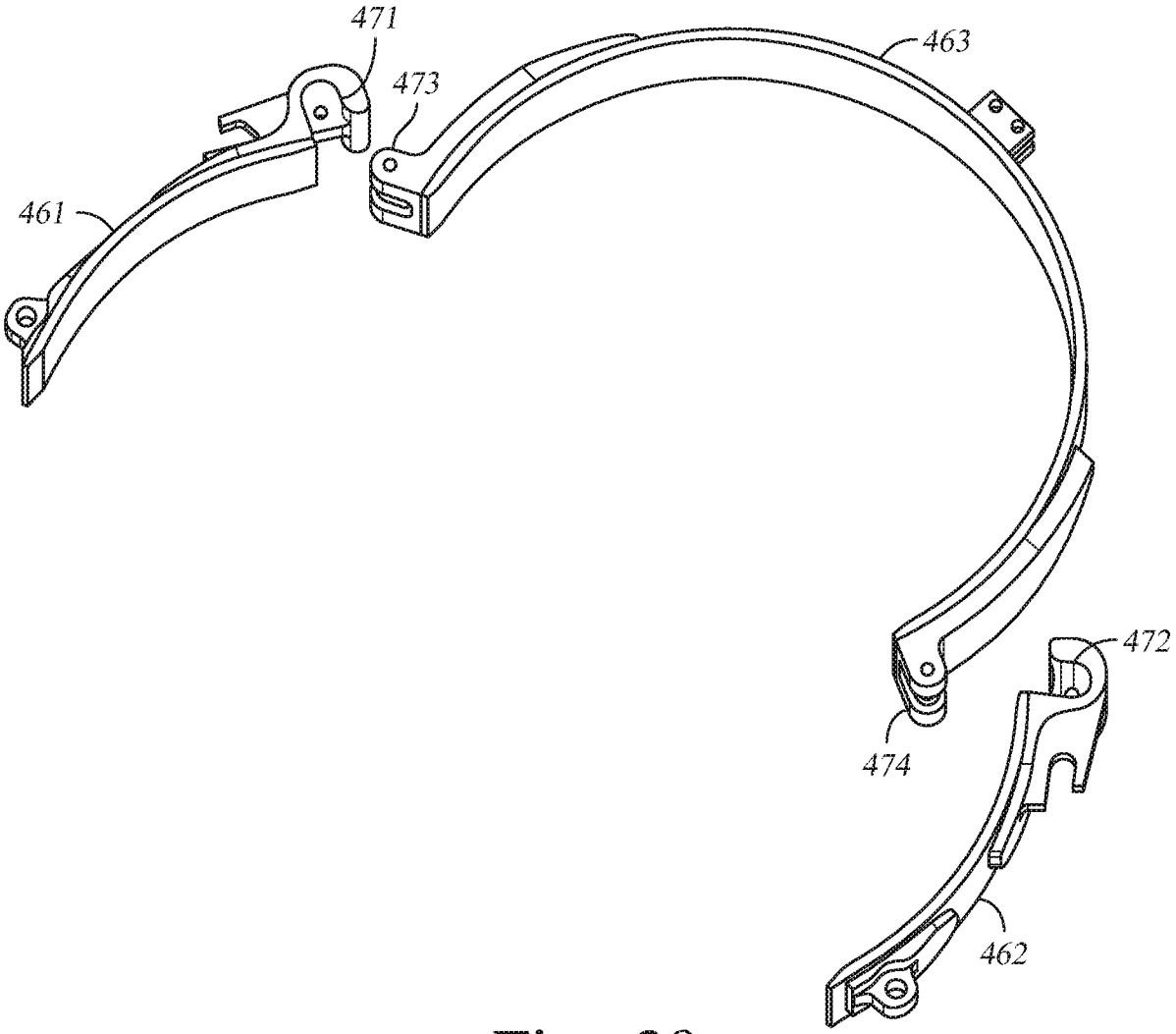
FIG. 20 is a perspective view of the brake band of FIG. 18 with both door bands in the disengaged position.

In one embodiment, the door bands 461, 462 are connected to the body band 463 using a latch 470, as shown in FIG. 18. The latch 470 includes a catch 471, 472 on the door bands 461, 462 for receiving a dog 473, 474 protruding from the body band 463. In one example, the catch 471, 472 has a hook shape. When the dog 473, 474 is engaged in the catch 471, 472, a pull force from the braking member 465 is transferred to the body band 463 to tighten the brake band 460 around the brake plate 440. The latch 470 is configured such that as the doors 421, 422 open, the catch 471, 472 disengages from the dogs 473, 474. FIG. 17 shows the catch 471 on the first door band 461 engaged with the dog 473 on the body band 463, and the catch 472 on the second door band 462 fully disengaged from the dog 474 on the body band 463. FIG. 19 shows the catch 471 on the first door band 461 fully disengaged from the dog 473 on the body band 463, and the catch 472 on the second door band 462 partially disengaged from the dog 474 on the body band 463. FIG. 20 shows the catch 471, 472 on both door bands 461, 462 fully disengaged from the dogs 473, 474 of the body band 463 as a result of opening the doors 421, 422.

In operation, the doors 421, 422 are opened to allow a tubular to enter the tong 400. As the doors 421, 422 open, the door bands 461, 462 move with the doors 421, 422 and disengage from the dogs 473, 474 on the body band 463. FIG. 20 shows the door bands 461, 462 disengaged from the body band 463. After the tubular enters the tong 400, the doors 421, 422 are closed. As the doors 421, 422 rotate back, the catch 471, 472 will engage the respective dog 473, 474. FIG. 19 shows the first door band 461 still disengaged from the body band 463, and the second door band 462 partially engaged with the door band 463. It can be seen the dog 474 is partially engaged with the catch 472 on the second door band 462. When the doors 421, 422 are closed, the door bands 461, 462 are engaged with the body band 463. FIG. 18 shows the catch 471, 472 on both door bands 461, 462 engaged with the dogs 473, 474 of the body band 463 as a result of closing the doors 421, 422.

To grip a tubular, the braking member 465 is activated to tighten the brake band 460 around the brake plate 440. The brake band 460 applies a frictional force against the brake plate 440 to prevent rotation of the carrier ring 450. In this respect, the gear ring 459 is allowed to rotate relative to the carrier ring 450. The gear ring 459 may act as a cam to urge the gripping members 408 into contact with the tubular.

Figure 22:
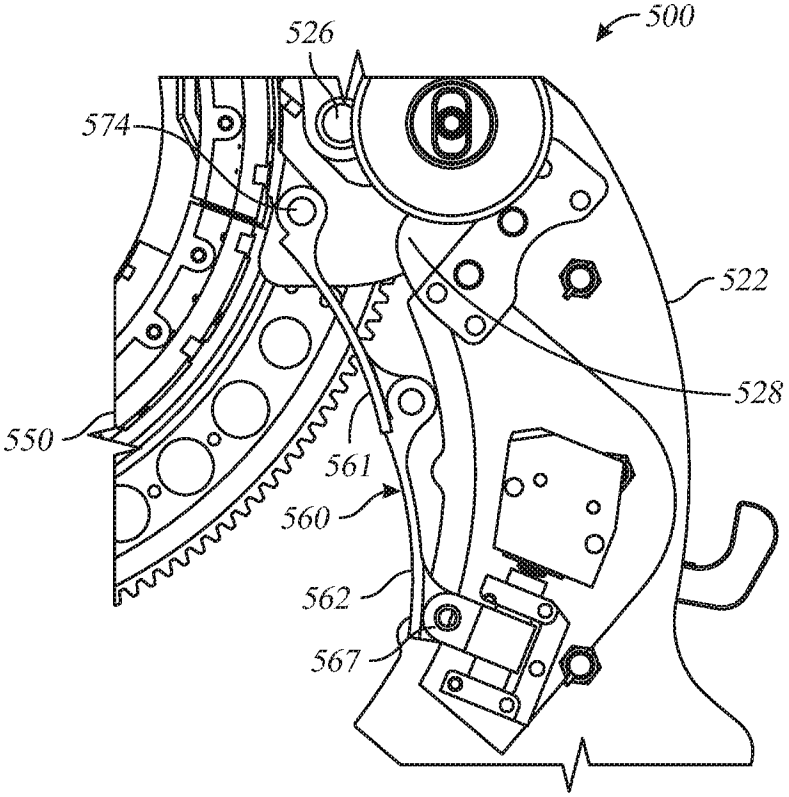
FIG. 22 is a partial, perspective view of the tong of FIG. 21 with one door in the open position.
Figure 21:
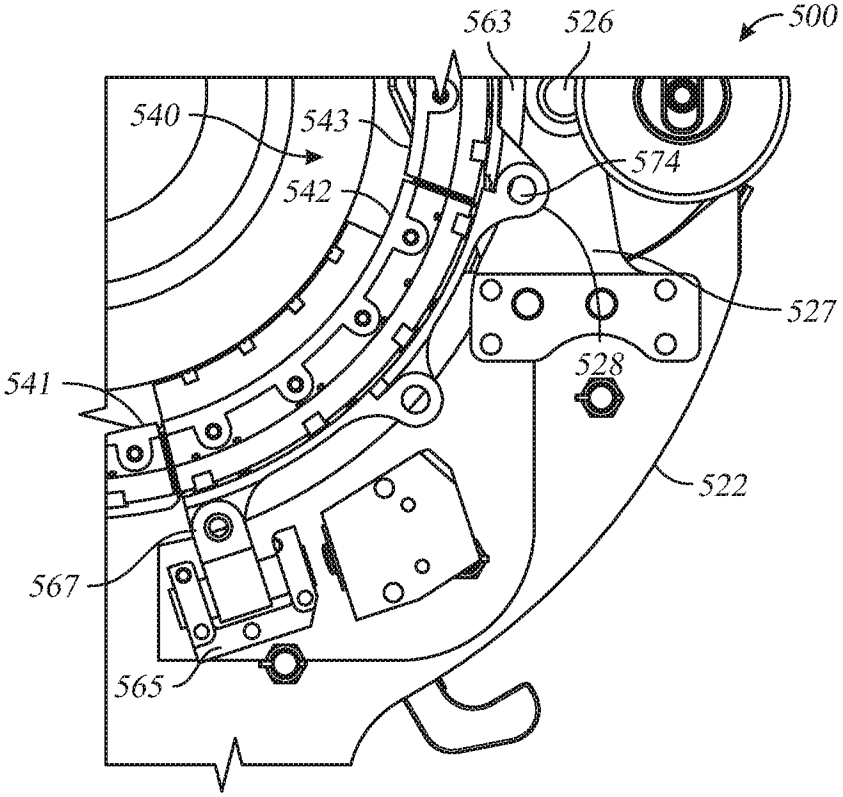
FIG. 21 is a partial, perspective view of another embodiment of a wellbore tong.

FIG. 21 is a partial, perspective view of another embodiment of a wellbore tong 500. FIG. 22 is a perspective view of the tong 500 with one door 522 in the open position. Because the tong 500 has many of the same features described in the tong 400 shown in FIG. 17, the tong 500 will be described with respect to only one of the doors 522. The door 522 pivots at the door hinge 526 relative to the tong body. The door 522 is opened to allow ingress or egress of a tubular. The door 522 can be opened using any suitable mechanism, such as a piston and cylinder assembly or manually. The tong 500 includes a gripping assembly having a carrier ring 550 housing one or more gripping members. It is contemplated that any suitable carrier ring and gripping members, such as those shown in FIGS. 16 and 17 may be used.

In one embodiment, the carrier ring 550 is a segmented carrier ring having a body ring portion and two door ring portions, e.g., carrier ring 450 of FIGS. 16, 17. Only one door 522 is shown in FIG. 22. The door ring portion is movable with the door 522, when the door 522 opens or closes. However, FIG. 22 shows the door ring portion in the closed position while the door 522 is open in order to more clearly show the features of the brake band 560.

The tong 500 includes a segmented brake plate 540 having a body plate 543 and two door plates 541, 542. The body plate 543 is attached to the body ring portion, and each door plate 541, 542 is attached to a door ring portion. The brake plate 540 is rotatable with the carrier ring 550. In this embodiment, the brake plate 540 is attached to a lower surface of the carrier ring 550. In another embodiment, the brake plate 540 is attached to an upper surface of the carrier ring 550. The door plate 542 is movable with the respective door 522, when the door 522 opens or closes. In one embodiment, a brake pad is attached to a perimeter wall surface of the brake plate 540. An exemplary brake pad is the brake pad 145 described in FIGS. 10-12. As discussed, one or more brake pads can be attached to apertures in the perimeter wall surface of the brake plate 540.

In one embodiment, the tong 500 includes one or more brake bands 560 for holding or stopping rotation of the carrier ring 550. In FIG. 22, the brake band 560 is coupled to the door 522. While not shown, another brake band 560 is preferably coupled to the other door. The brake band 560 includes a first segment 561 pivotally coupled to a second segment 562. In another embodiment, the brake band 560 is a single segment or includes three or more segments. A first end of the brake band is pivotally coupled to a braking member 565, and a second end of the brake band is pivotally coupled to the tong body. In this embodiment, a band hinge plate 563 is attached to the tong body. The first segment 561 of the brake band 560 is pivotally attached to a pin 574 on the door hinge plate 563. In this embodiment, a hinge cut out 528 is formed in the door hinge plate 527 to accommodate the pin 574 and the door band 560. The second segment 562 is pivotally attached to a hinge 567 of the braking member 565. The hinge 567 extends from the piston of the braking member 565 and is movable with the piston.

In operation, the doors of the tong 500 are opened to allow a tubular to enter the tong 500. For sake of clarity, only the operation of one of the doors 522 will be described. As the door 522 opens, the brake band 560 moves with the door 522 and pivot about the pin 574 on the band hinge plate 575. The brake band 560 also pivots relative to the braking member 565. The piston of the braking member 565 also moves the hinge 567 as the door 522 opens. FIG. 22 shows the brake band 560 in the open position with the door 522. After the tubular enters the tong 500, the door 522 is closed. As the door 522 rotates back, the brake band 560 will rotate with the door 522 about the pivotal connections 574, 567. FIG. 20 shows the brake band 560 in the closed position. The hinge 567 has moved from the position shown in FIG. 22. The braking member 565 is activated to tighten the brake band 560 around the brake plate 540. The brake band 560 applies a frictional force against the brake plate 540 to prevent rotation of the carrier ring 550. In this respect, a gear ring is allowed to rotate relative to the carrier ring 550, thereby urging the gripping members into contact with the tubular.

Figure 24:
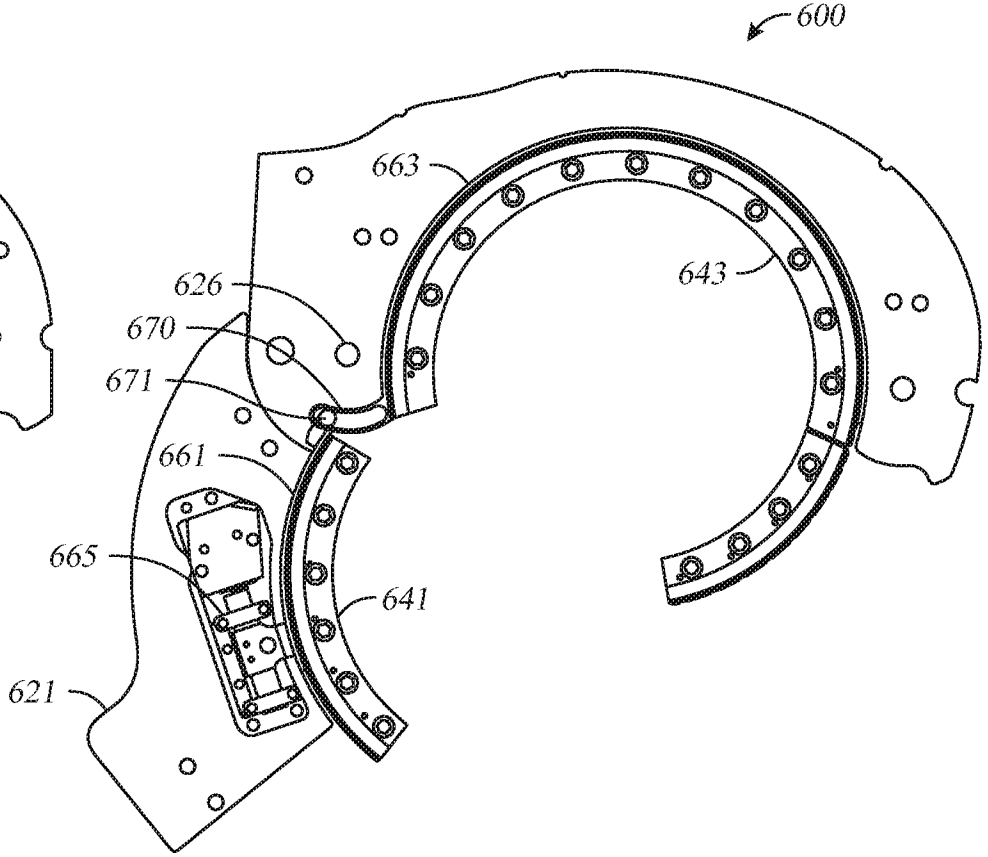
FIG. 24 is a partial, perspective view of the tong of FIG. 23 with one door in the open position.
Figure 23:
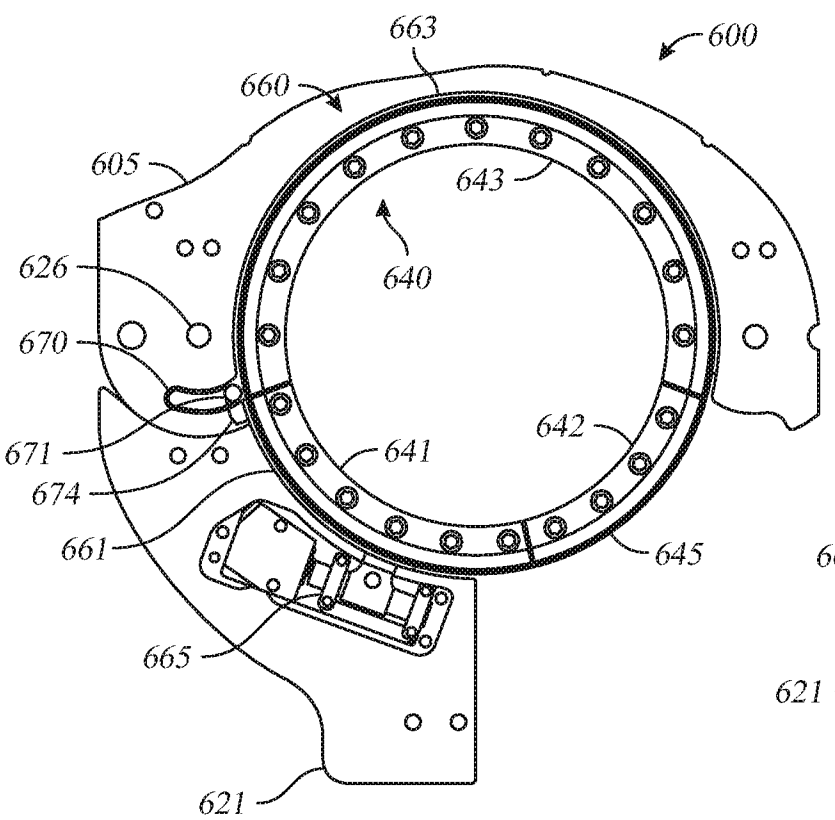
FIG. 23 is a partial, perspective view of another embodiment of a wellbore tong.

FIG. 23 is a partial, perspective view of another embodiment of a wellbore tong 600. FIG. 24 is a perspective view of the tong 600 with one door 621 in the open position. Because the tong 600 has many of the same features described in the tong 400 shown in FIG. 17, the tong 600 will be described with respect to only one of the doors 621. The other door is not shown for sake of clarity. The door 621 pivots at the door hinge 626 relative to the tong body 605. The door 621 is opened to allow ingress or egress of a tubular. The door 621 can be opened using any suitable mechanism, such as a piston and cylinder assembly or manually. The tong 600 includes a gripping assembly having a carrier ring (such as carrier ring 450 of FIGS. 16, 17) and a gripping member, which are not shown for sake of clarity. It is contemplated that any suitable gripping assembly, such as those shown in FIGS. 1-2 and 16-17 may be used. In one embodiment, the carrier ring is a segmented carrier ring having a body ring portion and two door ring portions. The door ring portion is movable with the door 621, when the door 621 opens or closes.

The tong 600 includes a segmented brake plate 640 having a body plate 643 and two door plates 641, 642. The body plate 643 is attached to the body ring portion, and each door plate 641, 642 is attached to a door ring portion. The brake plate 640 is rotatable with the carrier ring. In one embodiment, the brake plate 640 is attached to a lower surface of the carrier ring. In another embodiment, the brake plate 640 is attached to an upper surface of the carrier ring. The door plate 641 is movable with the respective door 621, when the door 621 opens or closes. In one embodiment, a brake pad 645 is attached to a perimeter wall surface of the brake plate 640. An exemplary brake pad is the brake pad 145 described in FIGS. 10-12. As discussed, one or more brake pads can be attached to apertures in the perimeter wall surface of the brake plate 640.

In one embodiment, the tong 600 includes a brake band 660 having a plurality of segments. FIG. 23 shows an exemplary embodiment of the brake band 660. The brake band 660 is disposed around a perimeter of the brake plate 640 and configured to make contact with the brake plate 640. The brake band 660 includes a body band 663 coupled to the body 605 of the tong 600. The brake band 660 may be attached to the body 605 using a bracket and one or more retainers may be used to keep the brake band 660 in position around the brake plate 640. The brake band 660 also includes a first door band 661 and a second door band. For sake of clarity, this embodiment will be described with respect to the first door band 661 since the second door band operates in a similar manner. The first door band is coupled to the door 621 and is movable with the door 621 as the door 621 opens or closes. The first door band 661 is coupled to the door 621 using a braking member 665 such as a piston and cylinder assembly. In one embodiment, the first door band 661 includes a hinge for pivotally coupling with the piston of the braking member 665. For example, a pin can be inserted through a hole in the hinge and a hole in the piston. In this manner, the first door band 661 can be moved by the respective braking member 665.

In one embodiment, the door bands 661 are connected to the body band 663 using a guide slot 670, as shown in FIG. 23. In this embodiment, the guide slot 670 is attached to the body band 663. A pin 671 on the first door band 661 is disposed in the guide slot 670. The guide slot 670 is configured to accommodate movement of the pin 671 as the first door 621 opens or closes. In one example, the guide slot 670 has a curved shape. The pin 671 may be coupled to the first door band 661 using an adapter 674. In FIG. 23, the first door 621 is in a closed position. When a pull force from the braking member 665 is applied to the first door band 661, the pull force is transferred from the first door band 661 to the body band 663 via the pin 671 and guide slot 670. In this respect, the braking member 665 can apply the pull force to tighten the brake band 660 around the brake plate 640. FIG. 24 shows the first door 621 in the open position. The pin 671 has moved outwardly with the first door 621 and along the guide slot 670.

In operation, the doors of the tong 600 are opened to allow a tubular to enter the tong 600. For sake of clarity, only the operation of one of the doors 621 will be described. As the door 621 opens, the first door band 661 moves with the door 621 and the pin 671 of the first door band 661 moves along the guide slot 670. FIG. 24 shows the door 621 and the first door band 661 in the open position. After the tubular enters the tong 600, the door 621 is closed. As the door 621 rotates back, the pin 671 of the first door band 661 moves back along the guide slot 670 toward the body band 663. FIG. 23 shows the door 621 and the first door band 461 in the closed position. The braking members 665 are activated to tighten the brake band 660 around the brake plate 640. Force from the braking member 665 is applied to the first door band 661 and transferred to the body band 663 via the pin 671 and the guide slot 670. The brake band 660 applies a frictional force against the brake plate 640 to prevent rotation of the carrier ring 550. In this respect, the gear ring is allowed to rotate relative to the carrier ring 550, thereby urging the gripping members into contact with the tubular.

In one embodiment, a method of operating a tong includes opening a door of the tong. The tong may include a tong body; the door pivotally coupled to the tong body; a carrier ring rotatable relative to the tong body; a brake plate coupled to the carrier ring; and a brake band having a door band portion attached to the door. The method also includes moving the door band portion of the brake band with the door as the door opens; closing the door; rotating the carrier ring; and moving the brake band into contact with the brake plate, thereby stopping rotation of the carrier ring.

In one embodiment, a tong for use at a wellbore includes a tong body; at least one door pivotally coupled to the tong body and movable between an open position and a closed position; a carrier ring rotatable relative to the tong body; a brake plate coupled to the carrier ring; a brake band configured to move with the at least one door between the open and closed positions; and a braking member for moving the brake band into contact with the brake plate to stop rotation of the carrier ring.

In one embodiment, a tong for use at a wellbore includes a tong body; at least one door pivotally coupled to the tong body and movable between an open position and a closed position; a gripping assembly rotatable relative to the tong body; and a brake plate coupled to the gripping assembly. The tong may also include a brake band configured to move with the at least one door between the open and closed positions; and a braking member for moving the brake band into contact with the brake plate to stop rotation of the gripping assembly.

In one or more of the embodiments described herein, the brake band includes a body band attached to the tong body; and a door band attached to and movable with the door, wherein the door band is engaged with the body band when the door is in the closed position, and the door band is disengaged from the body band when the door is in the open position.

In one or more of the embodiments described herein, the door band includes a catch configured to receive a dog of the body band when the door is in the closed position.

In one or more of the embodiments described herein, the braking member is attached to the door.

In one or more of the embodiments described herein, the brake plate includes a body plate attached to the tong body and a door plate attached to and movable with the door.

In one or more of the embodiments described herein, the tong includes a first door and a second door, and the brake band includes a body band attached to the tong body; a first door band attached to and movable with the first door; and a second door band attached to and movable with the second door, wherein the first and second door bands are engaged with the body band when the doors are in the closed position, and the first and second door bands are disengaged from the body band when the doors are in the open position.

In one or more of the embodiments described herein, the first end of the brake band is pivotally attached to the door, and a second end of the brake band is pivotally attached to the tong body.

In one or more of the embodiments described herein, the second end of the brake band is pivotally attached to a pin on the tong body.

In one or more of the embodiments described herein, the braking member is attached to the door, and wherein the first end of the brake band is pivotally coupled to the braking member.

In one or more of the embodiments described herein, the brake band includes a first brake band portion pivotally coupled to a second brake band portion.

In one or more of the embodiments described herein, the door includes a hinge cut out to accommodate the pin.

In one or more of the embodiments described herein, the brake band includes a first brake band portion pivotally coupled to a second brake band portion.

In one or more of the embodiments described herein, the braking member pivotally couples the first brake band portion to the second brake band portion.

In one or more of the embodiments described herein, the braking member includes a first piston coupled to the first brake band portion and a second piston coupled to the second brake band portion.

In one or more of the embodiments described herein, the tong includes a first door and a second door, wherein the first end of the brake band is pivotally attached to the first door and the second end of the brake band is pivotally attached to the tong body. The tong may further include a second brake band having a first end pivotally attached to the second door and a second end pivotally attached to the tong body.

In one or more of the embodiments described herein, the brake band includes a body band attached to the tong body and having a guide slot; and a door band attached to and movable with the door, wherein the door band is coupled to the guide slot.

In one or more of the embodiments described herein, the door band includes a pin disposed in the guide slot.

In another embodiment, a method of operating a tong includes opening a door of the tong, wherein the tong includes a tong body; the door pivotally coupled to the tong body; a carrier ring rotatable relative to the tong body; a brake plate coupled to the carrier ring; and a brake band having a door band portion attached to the door. The method also includes moving the door band portion of the brake band with the door as the door opens; closing the door; moving the brake band into contact with the carrier ring, thereby preventing rotation of the carrier ring; and rotating a gear ring relative to the carrier ring.

In one or more of the embodiments described herein, moving the door band portion includes disengaging the door band portion from a body band portion of the brake band attached to the tong body.

In one or more of the embodiments described herein, closing the door includes engaging the door band portion with the body band portion.

In one or more of the embodiments described herein, moving the brake band into contact includes transferring a force from the door band portion to the body band portion.

In one or more of the embodiments described herein, moving the door band portion includes moving a pin of the door band portion along a guide slot of a body band portion of the brake band.

In one or more of the embodiments described herein, moving the brake band into contact with the brake plate includes actuating a braking member to apply a force to the brake band to move the brake band relative to the brake plate.

While the foregoing is directed to embodiments of the present disclosure, other and further embodiments of the disclosure may be devised without departing from the basic scope thereof, and the scope thereof is determined by the claims that follow.

The invention claimed is:

1. A tong for use at a wellbore, comprising:

a tong body;

at least one door pivotally coupled to the tong body and movable between an open position and a closed position;

a carrier ring rotatable relative to the tong body;

a brake plate coupled to the carrier ring;

a brake band configured to move with the at least one door between the open and closed positions; and a braking member for moving the brake band into contact with the brake plate to stop rotation of the carrier ring.

2. The tong of claim 1, wherein the brake band includes:

a body band attached to the tong body; and a door band attached to and movable with the door, wherein the door band is engaged with the body band when the door is in the closed position, and the door band is disengaged from the body band when the door is in the open position.

3. The tong of claim 2, wherein the door band includes a catch configured to receive a dog of the body band when the door is in the closed position.

4. The tong of claim 3, wherein the braking member is attached to the door.

5. The tong of claim 2, wherein the brake plate includes a body plate attached to the tong body and a door plate attached to and movable with the door.

6. The tong of claim 2, wherein the tong includes a first door and a second door, and the brake band includes:

a body band attached to the tong body;

a first door band attached to and movable with the first door; and a second door band attached to and movable with the second door, wherein the first and second door bands are engaged with the body band when the doors are in the closed position, and the first and second door bands are disengaged from the body band when the doors are in the open position.

7. The tong of claim 1, wherein the first end of the brake band is pivotally attached to the door, and a second end of the brake band is pivotally attached to the tong body.

8. The tong of claim 7, wherein the second end of the brake band is pivotally attached to a pin on the tong body.

9. The tong of claim 8, wherein the braking member is attached to the door, and wherein the first end of the brake band is pivotally coupled to the braking member.

10. The tong of claim 9, wherein the brake band includes a first brake band portion pivotally coupled to a second brake band portion.

11. The tong of claim 8, wherein the door includes a hinge cut out to accommodate the pin.

12. The tong of claim 7, wherein the brake band includes a first brake band portion pivotally coupled to a second brake band portion.

13. The tong of claim 12, wherein the braking member pivotally couples the first brake band portion to the second brake band portion.

14. The tong of claim 7, wherein the tong includes a first door and a second door, wherein the first end of the brake band is pivotally attached to the first door and the second end of the brake band is pivotally attached to the tong body, and further comprising:

a second brake band having a first end pivotally attached to the second door and a second end pivotally attached to the tong body.

15. The tong of claim 1, wherein the brake band includes:

a body band attached to the tong body and having a guide slot; and a door band attached to and movable with the door, wherein the door band is coupled to the guide slot.

16. The tong of claim 15, wherein the door band includes a pin disposed in the guide slot.

17. A tong for use at a wellbore, comprising:

a tong body;

at least one door pivotally coupled to the tong body and movable between an open position and a closed position;

a gripping assembly rotatable relative to the tong body;

a brake plate coupled to the gripping assembly;

a brake band configured to move with the at least one door between the open and closed positions; and a braking member for moving the brake band into contact with the brake plate to stop rotation of the gripping assembly.

18. A method of operating a tong, comprising:

opening a door of the tong, wherein the tong includes:

a tong body;

the door pivotally coupled to the tong body;

a carrier ring rotatable relative to the tong body;

a brake plate coupled to the carrier ring; and a brake band having a door band portion attached to the door;

moving the door band portion of the brake band with the door as the door opens;

closing the door;

moving the brake band into contact with the carrier ring, thereby preventing rotation of the carrier ring; and rotating a gear ring relative to the carrier ring.

19. The method of claim 18, wherein moving the door band portion comprises disengaging the door band portion from a body band portion of the brake band attached to the tong body.

20. The method of claim 18, wherein moving the door band portion comprises moving a pin of the door band portion along a guide slot of a body band portion of the brake band.

* * * * *